US005750750A

United States Patent [19]

Duncan et al.

[11] Patent Number: 5,750,750

[45] Date of Patent: May 12, 1998

[54] HIGH VISCOSITY COMPLEX ALCOHOL ESTERS

[75] Inventors: Carolyn Boggus Duncan; Paul R. Geissler; David Wayne Turner, all of Baton Rouge, La.; William Joseph Munley, Jr., Houston, Tex.; Martin A. Krevalis, Baton Rouge, La.

[73] Assignee: Exxon Chemical Patents Inc., Houston, Tex.

[21] Appl. No.: 799,011

[22] Filed: Feb. 7, 1997

[51] Int. Cl.[6] ..... C07C 59/47

[52] U.S. Cl. ..... 554/117; 554/121; 554/122; 508/485; 508/492; 508/495; 560/126; 560/182; 560/193; 560/194; 560/198; 560/199

[58] Field of Search ..... 508/485, 492, 508/495; 554/117, 121, 122; 560/126, 182, 193, 194, 198, 199

[56] References Cited

U.S. PATENT DOCUMENTS

| | | |
|---|---|---|
| 2,628,974 | 2/1953 | Sanderson . |
| 2,805,247 | 9/1957 | Krischai . |
| 2,884,399 | 4/1959 | Barnart et al. . |
| 3,016,353 | 1/1962 | Matuszak . |
| 3,048,623 | 8/1962 | Matuszak et al. . |
| 3,148,200 | 9/1964 | Mills et al. . |
| 3,194,764 | 7/1965 | Ovist et al. . |
| 3,202,701 | 8/1965 | Young et al. . |
| 3,278,586 | 10/1966 | Ovist et al. . |
| 3,360,546 | 12/1967 | Hequembourg . |
| 3,377,377 | 4/1968 | Kluge . |
| 3,697,428 | 10/1972 | Meinhardt et al. . |
| 3,888,909 | 6/1975 | Dieterman et al. . |
| 3,956,220 | 5/1976 | Riem et al. . |
| 3,984,445 | 10/1976 | Takeo et al. . |
| 4,036,771 | 7/1977 | Denis et al. . |
| 4,155,861 | 5/1979 | Schmitt et al. . |
| 5,658,863 | 8/1997 | Dyncan et al. . |
| 5,665,686 | 9/1997 | Schlosberg . |

FOREIGN PATENT DOCUMENTS

| | | |
|---|---|---|
| 736513 | 6/1966 | Canada . |
| 182526 | 5/1986 | European Pat. Off. . |
| 0 568 348 | 11/1993 | European Pat. Off. . |
| 2307867 | 11/1976 | France . |
| 2511905 | 9/1975 | Germany . |
| 70004740 | 1/1965 | Japan . |
| 1060750 | 3/1967 | Japan . |
| 72042821 | 10/1972 | Japan . |
| 60-045547 | 3/1985 | Japan . |
| 60-056657 | 3/1985 | Japan . |
| 62-045561 | 2/1987 | Japan . |
| 62045561 | 2/1987 | Japan . |
| 63-107947 | 5/1988 | Japan . |
| 03217493 | 9/1991 | Japan . |
| 05025484 | 2/1993 | Japan . |
| 06025682 | 2/1994 | Japan . |
| 06025683 | 2/1994 | Japan . |
| 7330670 | 12/1995 | Japan . |
| 6408397 | 1/1966 | Netherlands . |
| 1526825 | 10/1978 | United Kingdom . |

OTHER PUBLICATIONS

*Complex Esters As Antiwear Agents* by Misra; et al., dated Apr. 26, 1973, pp. 229–237.

*Journal of Applied Chemistry of the USSR*; Sep., 1972, vol. 45, No. 4, Part 2; 3 pages.

*Synthetic Lubricants And High–Performance Functional Fluids*, by Ronald L. Shubkin, pp. 41 & 64, 1989.

*Synthesis, Evaluation and Applications of Complex Esters As Lubricants: A Basic Study*; by P.S. Venkataramani et al., JSL, pp. 271–289, 1988.

*A Route To Quantitative carbon–13 NMR Analysis Of Multicomponent Polyesters* by Soeren Hvilsted; Makromol. Chem., Macromol. Symp. 1991, 177–184.

*Carbon–13 NMR Analysis of Crosslinking Sites In Branched Polyesters* by Soeren Hvilsted; Biol. Synth. Polym. Networks, 1988, 243–54.

*Reactive Oligomers. 5. Polymerization of Ethylene Glycol Bis(isopropyl fumarate), ethylene glycol bis(n–butyl fumarate), and diethylene glycol bis(n–butyl fumarate* by Akira Matsumoto et al.; J. Polym. Sci. Part a: Polym. Chem. 1988.

*Reactive Oligomers. I. Preparation and Polymerization of Ethylene Glycol Bis(methyl fumarate)*; Akira Matsumoto et al.; J. Polym. Sci. Polym. Chem. Ed., 1983, 21(11).

*Reactive Oligomers With Triple Bonds. II. Synthesis And Study of the Properties of Oligoester Propargyl Esters*; S.G. Grigoryan et al; Am. Khim. Zh., 1979, 32(11), 911–14.

*Effect of Number of Carboxyl Groups on Liquid Density of Esters of Alkylcarboxylic Acids*; Joseph C. Phillips; J. Chem. Eng. Data, 1978, 23(1), 1–6.

*Pyrolysis of poly(l,4–butylene adipatae)*; Francois Messier et al.; Can. J. Chem., 1977, 55(14),.

*Correlation of Liquid Heat–Capacities for Carboxylic Esters*; Joseph C. Phillips, et al.; J. Chem. Eng. Data, 1976 21(2), 228–32.

(List continued on next page.)

*Primary Examiner*—Samuel Barts

*Attorney, Agent, or Firm*—John F. Hunt

[57] ABSTRACT

A complex alcohol ester which comprises the reaction product of an add mixture of the following: a polyhydroxyl compound represented by the general formula:

$$R(OH)_n$$

wherein R is any aliphatic or cyclo-aliphatic hydrocarbyl group and n is at least 2, provided that the hydrocarbyl group contains from about 2 to 20 carbon atoms; a polybasic acid or an anhydride of a polybasic acid, provided that the ratio of equivalents of the polybasic acid to equivalents of alcohol from the polyhydroxyl compound is in the range between about 1.6:1 to 2:1; and a monohydric alcohol, provided that the ratio of equivalents of the monohydric alcohol to equivalents of the polybasic acid is in the range between about 0.84:1 to 1.2:1; wherein the complex alcohol ester exhibits a pour point of less than or equal to −20° C., a viscosity in the range between about 100–700 cSt at 40° C. and having a polybasic acid ester concentration of less than or equal to 70 wt. %, based on the complex alcohol ester.

25 Claims, 1 Drawing Sheet

OTHER PUBLICATIONS

*Liquid (melt) Heat Capacities and Heats of Vaporization of Oligomers of Poly(hesamethylene sebacate)*; J.C. Phillips; Polym. Eng. Sci., 1975, 15(2), 73–8.
*Mass Spectra and Qualitative Analysis of Esters of Aliphatic Dicarboxylic Acids*; L.N. Sosulina; Zh. Org. Khimm, 1974, 10(7), 1350–5.
*Lubricants for Precision Mechanisms*; A.K. Misra et al.; Proc. World Conf. Ind. Tribol., 1973.
*New Lubricants. Esters and Polyesters of Pentaerythritol*; Witold Pawlowski et al., Przem. Chem., 1974, 51(8).
*Mixed Esters of 1,10–decanedicarboxylic acid*; I.A. Volkova et al; Zh. Prikl. Khim. (Leningrad) 1972; 45(4).
*Substances Contained in Polyesters of the System Triol–monool–dicarboxylic Acid*; R. Schoellner; Plaste kaut. 1968, 15(3).
*New Derivatives of Pentaerythritol*; Bela Zsadon et al.; Magyar Kem. Folybiral 65, 253–6, 1959.
*Light–switched Chromophoric Device Designed From an Ionophoric Calix[4]arene*; Gang Deng et al.; J. Polym. Sci., Part a: Polym. Chem., 1993, 31(7).
*Photoimaging Composition Containing Oligomer Maleic Acid Ester and Fumaric Acid Ester for Preparation of Relief Printing Plates*; Joachim Gersdorf, Ger. Offen., 8 pp., 1991.
*Mixed Esters for Plasticizers for Poly(vinyl chloride)*; Tetsu Matsumoto; Jpn. Kokai Tokkyo Koho, 7pp., 1980.
*Diol Alkenyl Fumarates for Preparation of Highly Crosslinked Polymers*; Tkayuki Otsu et al.; Jpn. Kokai Tokkyo Koho, 6, 1980.
*Diol Bis(alkyl fumaate) Compounds*; Masayoshi Oiwa; Jpn. Kokai Tokkyo Koho, 7 pp., 1980.
*Polyol Poly(allylesters)*; Masaaki Oba et al.; Japan. Kokai, 4 pp., 1980.
*Complex Ester Plasticizers and Lubricants*; Tetsu Matsumoto; Jpn. Kokai Tokkyo Koho, 11 pp., 1980.
*Effect of Small Amounts of the Plasticizer Propylene Glycol Adipate Dibutyl Ester on the High–speed Extrusion of Rigid PVC*; H.R. Vargas et al.; Rev. Plast. Mod., 1986, 51(360).
*Membrane Manufacturing Method*; Inorganic Analytical Chemistry, 1980.
*Refrigerator Working Fluid Compositions*; Fossil Fuels, Derivatives and Related Products, 1980.
*Liquid Compositions Containing Carboxylic (poly)esters*; Industrial Organic Chemicals, Leather, Fats and Waxes, 1976.
*Multisensor array for pH, Potassium(1+), sodium(1 +) and calcium(2+) Measurements based on Coated–film Electrodes*; Inorganic Analytical Chemistry, 1976.
*Study of the Surface Activity of Dialkyl Disulfossuccinoethane Salts*; Surface Active Agents and Detergents, 1975.
*Multisensor Aray for pH, Potassium(1+); Sodium(1+) and Calcium(2+) Measurements Based on Coated–film Electrodes*; Inorganic Analytical Chemistry, 1991.
*Study of the Surface Activity of Dialkyl Disulfosuccionoethane Salts*; Plastics Manufacture and Processing, 1991.
*Polyester Plasticizers Containing Trimellitate Ester Mixtures*; Plastics Manufacture and Processing, 1991.
*Lubricants Containing Crosslinked Esters for Processing Thermoplastic Synthetic Fibers*; Textiles and Fibers, 1990.
*Lubricants Containing Ester–Olefin Reaction Products for Processing Thermoplastic Synthetic Fibers*; Textiles and Fibers, 1990.
*Lubricants Containing Ester Polymers for Processing Thermoplastic Synthetic Fibers*; Textiles and Fibers, 1990.
*Active Methylene Compounds and Receptors as Curing Systems for Coatings*; Coatings, Inks, and Related Products, 1983.
*Stretchable Polyethylene Films*; Plastics Manufacture and Processing, 1983.
*Potentiometric Method and Apparatus for Determining the Concentration Ratio of Lithium to Sodium Ions*; Inorganic Analytical Chemistry, 1983.
*Dicarboxylic Acid Diamides, Method for Producing Them, Their Sodium Complexes, and Ion–Selective Components for Determing Sodium Complexes*; Inorganic Analytical Chemistry, 1983.
*Photocured Polymers In Ion–selective Electrode Membranes, Part 1. A Potassium Electrode for Flow–Injection Analysis*; Inorganic Analytical Chemistry, 1991.
*Stabilizers for Halogen–containing Polymers Comprising the Product of a Diorganotin Oxide, an Ethylenically Unsaturated Dicarboxylic Acid Ester and a Mercaptan*; Plastics Manufacture and Processing, 1991.
*Esterification and/or Ester Interchange Catalyst*; Industrial Organic Chemicals, Leather, Fats and Waxes, 1991.
*Bicarbonate–sensitive Electrode Based on Planar Thin Membrane Technology*; Inorganic Analytical Chemistry, 1982.
*Selective transport Membranes and Their Applicability for Novel Sensors*; Electrochemistry, 1982.
*Design of Neutral Hydrogen Ion Carriers for Solvent Polymeric Membrane Electrodes of Selected pH Range*; Inorganic Analytical Chemistry, 1982.
*Radical Copolymerization of Ethylene Glycol Bis(methyl fumarate) with N–vinylcarbazole*; Chemistry of Synthetic High Polymers, 1982.
*Stabilizers for PVC*; Plastics Manufacture and Processing, 1982.
*Bis(progargyloxymaleoyloxy)ethane as an Antiwear Additive for Spindle or Transformer Oil*; Fossil Fuels, Derivatives, and Related Products, 1990.
*Fiber Finishing Agents*; Textiles, 1990.
*Lubricant Finishes for Synthetic Fibers*; Textiles, 1991.
*Reactive Oligomers. II. Polymerization of Glycol (bis–allylphthalate)s and Glycol bis(allyl succinate)s*; Chemistry of Synthetic High Polymers, 1992.
*Synthesis of Vinyl Oligoesters*; Chemistry of Synthetic High Polymers, 1983.
*Easily Crosslinkable Polymer Material*; Plastics Manufacture and Processing, 1982.
*Readily–crosslinked Plastics*; Plastics Manufacture and Processing, 1981.
*Foam Plastics*; Plastics Manufacture and Processing, 1982.
*Synthesis of Unsaturated Polyesters Based on Dicyclopentadiene Derivatives*; Plastics Manufacture and Processing, 1982.
*Plasticizers for Vinyl Polymers and Nylon 12*; Plastics Manufacture and Processing, 1983.
*Poly(vinyl chloride) Mixture and Its Fcopolymers Resistant Against Organic Aliphatic Solvents, Oils and Low Temperature*; Plastics Manufacture and Processing, 1987.
*Effect of Polyester Plasticizers on the Radiation Crosslinking of a PVC–triallyl Cyanurate Composition*; Plastics Manufacture and Processing, 1992.
*Antifriction Grease*; Petroleum, Petroleum Derivatives, and Related Products, 1991.
*Light–resistant Polypropylene Filaments*; Textiles, 1989.
*Light–resistant Polypropylene Filaments*; Textiles, 1991.
*2–Propynyl Bisesters*; Noncondensed Aromatic Compounds, 1992.
*Novel Polyallyl Esters, Their Production and Use*; Plastics Manufacture and Processing, 1993.
*Odorless Acrylic Adhesives*; Plastics Fabrication and Uses, 1991.

—□— ESTER OF TMP/AA/IDA WITH TETRA ISOPROPYL TITANATE ADDED AT 70.7% CONVERSION OF AA
—△— ESTER OF TMP/AA/IDA WITH TETRA ISOPROPYL TITANATE ADDED AT 85.3% CONVERSION OF AA
—+— ESTER OF TMP/AA/IDA WITH TETRA ISOPROPYL TITANATE ADDED AT 77.1% CONVERSION OF AA
—○— ESTER OF TMP/AA/IDA WITH TETRA ISOPROPYL TITANATE ADDED AT 80.4% CONVERSION OF AA

HIGH VISCOSITY COMPLEX ALCOHOL ESTERS

This application claims priority to the United States Provisional Patent Application Number 60/025,596 filed Sep. 6, 1996.

The present invention relates generally to high viscosity complex alcohol esters with low polybasic acid ester content for use as lubricant basestocks. In particular, it relates to complex alcohol esters formed by reacting a polyhydroxyl compound (i.e. a polyol) with a polybasic acid or anhydride of a polybasic acid, and a limited excess of monohydric alcohol, i.e., 0–20% excess alcohol, more preferably 0–15%. These complex alcohol esters are preferably biodegradable, have a high viscosity, low metals content, low acid content, good pour point, and provide excellent lubricity and seal swell.

BACKGROUND OF THE INVENTION

Lubricants in commercial use today are prepared from a variety of natural and synthetic basestocks admixed with various additive packages and solvents depending upon their intended application. The basestocks typically include mineral oils, highly refined mineral oils, poly alpha olefins (PAO), polyalkylene glycols (PAG), phosphate esters, silicone oils, diesters or polyol esters. Synthetic lubricants provide a valuable alternative to natural lubricants in a wide variety of applications.

Neopolyol esters usually are comprised of neopolyols and monocarboxylic acids. Thus, for example, use of neopolyols such as neopentyl glycol, trimethylolethane, trimethylolpropane, monopentaerythritol, technical grade pentaerythritol, dipentaerythritol, tripentaerythritol and the like can be esterified with carboxylic acids ranging from formic acid, acetic acid, propionic acid, up through long chain carboxylic acids both linear and branched. Typically, the acids employed range from $C_5$ to $C_{22}$.

One typical method of production of polyol esters would be to react a neopolyol with a carboxylic acid at elevated temperatures in the presence or absence of an added catalyst. Catalysts such as sulfuric acid, p-toluene sulfonic acid, phosphorous acid, and soluble metal esterification catalysts are conventionally employed.

While the method of production of neopolyol esters as outlined above is well known, the method produces materials with a set of standard properties. For a given combination of neopolyol and acid (or mixtures thereof) there is a set of product properties such as viscosity, viscosity index, molecular weight, pour point, flash point, thermal and oxidative stability, polarity, and biodegradability which are inherent to the compositions formed by the components in the recipe. To get out of the box of viscosity and other properties imposed by structure, attempts have been made to increase the viscosity of neopolyol esters by means of a second acid, a polybasic acid, in addition to, or instead of, the monocarboxylic acids described above. Thus, employing a polybasic acid such as, e.g., adipic acid, sebacic acid, azelaic acid and/or acid anhydrides such as, succinic, maleic and phthalic anhydride and the like enables one to have the components of a polymeric system when reacted with a neopolyol. By adding a poly- or di-basic acid to the mix, one is able to achieve some degree of cross-linking or oligomerization, thereby causing molecular size growth such that the overall viscosity of the system is increased. Higher viscosity oils are desirable in certain end use application such as greases, heavy duty engine oils, certain hydraulic fluids and the like.

Conventional complex alcohol esters are formed with adipates which result in poor seal swell properties and much lower viscosity (i.e., less than 100 cSt) than esters without adipates. Moreover, the present inventors have discovered that when the amount of linear monohydric alcohol exceed 20% of the total alcohol used, then the pour point is too high, e.g., above −30° C. Furthermore, the present inventors have discovered that the ratio of polybasic acid to polyol is critical in the formation of a complex alcohol ester. That is, if this ratio is too low then a complex alcohol ester contains undesirable amounts of heavies which reduce biodegradability and increases the hydroxyl number of the ester which increases the corrosive nature of the resultant ester which is also undesirable. If, however, the ratio is too high then the resultant complex alcohol ester will have an undesirably low viscosity and poor seal swell characteristics.

The complex alcohol esters of the present invention meet this need by providing lubricants with a unique level of biodegradability in conjunction with effective lubricating properties. They also provide excellent stability, low temperature properties (i.e., low pour points), low metal catalyst content, low acidity, high viscosity, and high viscosity index.

The complex alcohol ester with low polybasic acid ester content according to the present invention is formed by using no more than 20% molar excess alcohol during the reaction step. Furthermore, the present inventors have discovered that these unique complex alcohol esters according to the present invention can also be formed such that they have low metal catalyst and acid contents by treating the crude reactor product with water at elevated temperatures and pressures greater than one atmosphere. That is, the present inventors have unexpectedly discovered that high temperature hydrolysis can be used to remove a substantial portion of the metal catalyst from the complex alcohol ester reaction product without any significant increase in the total acid number of the resulting product.

The complex alcohol esters of the present invention also exhibit the following attributes: excellent lubricity, seal swell, biodegradability, low toxicity, friction modification, high viscosity, thermal and oxidative stability and polarity.

SUMMARY OF THE INVENTION

A complex alcohol ester which comprises the reaction product of an add mixture of the following: a polyhydroxyl compound represented by the general formula:

$$R(OH)_n$$

wherein R is any aliphatic or cyclo-aliphatic hydrocarbyl group and n is at least 2, provided that the hydrocarbyl group contains from about 2 to 20 carbon atoms; a polybasic acid or an anhydride of a polybasic acid, provided that the ratio of equivalents of the polybasic acid to equivalents of alcohol from the polyhydroxyl compound is in the range between about 1.6:1 to 2:1; and a monohydric alcohol, provided that the ratio of equivalents of the monohydric alcohol to equivalents of the polybasic acid is in the range between about 0.84:1 to 1.2:1; wherein the complex alcohol ester exhibits a pour point of less than or equal to −20° C., preferably −40° C., a viscosity in the range between about 100–700 cSt at 40° C., preferably between 100–200, and having a polybasic acid ester concentration of less than or equal to 70 wt. %, based on the complex alcohol ester.

When the polyhydroxyl compound is at least one compound selected from the group consisting of: technical grade pentaerythritol and mono-pentaerythritol, then the ratio of equivalents of the polybasic acid to equivalents of alcohol from the polyhydroxyl compound is preferably in the range between about 1.75:1 to 2:1.

When the polyhydroxyl compound is selected from the group consisting of trimethylolpropane, trimethylolethane and trimethylolbutane, then the ratio of equivalents of the polybasic acid to equivalents of alcohol from the polyhydroxyl compound is preferably in the range between about 1.6:1 to 2:1.

When the polyhydroxyl compound is di-pentaerythritol, then the ratio of equivalents of the polybasic acid to equivalents of alcohol from the polyhydroxyl compound is preferably in the range between about 1.83:1 to 2:1.

The unique complex alcohol ester according to the present invention exhibits lubricity, as measured by the coefficient of friction, less than or equal to 0.1 and is at least about 60% biodegradable as measured by the Sturm test, preferably the Modified Sturm test.

The complex alcohol ester may also exhibit at least one of the properties selected from the group consisting of: (a) a total acid number of less than or equal to about 1.0 mgKOH/gram, (b) a hydroxyl number in the range between about 0 to 50 mgKOH/gram, (c) a metal catalyst content of less than about 25 ppm, (d) a molecular weight in the range between about 275 to 250,000 Daltons, (e) a seal swell equal to about DTDA (diisotridecyladipate), (f) a viscosity at −25° C. of less than or equal to about 100,000 cps, (g) a flash point of greater than about 200° C., (h) aquatic toxicity of greater than about 1,000 ppm, (i) a specific gravity of less than about 1.0, (j) a viscosity index equal to or greater than about 150, and (k) an oxidative and thermal stability as measured by HPDSC at 220° C. of greater than about 10 minutes.

The present invention also covers a lubricant which comprises the aforementioned complex alcohol ester and a lubricant additive packages. The lubricant is preferably selected from the group consisting of crankcase engine oils, two-cycle engine oils, catapult oils, hydraulic fluids, drilling fluids, aircraft and other turbine oils, greases, compressor oils, functional fluids, gear oils, and other industrial and engine lubrication applications.

The preferred additive package comprises at least one additive selected from the group consisting of: viscosity index improvers, corrosion inhibitors, oxidation inhibitors, dispersants, lube oil flow improvers, detergents and rust inhibitors, pour point depressants, anti-foaming agents, anti-wear agents, seal swellants, friction modifiers, extreme pressure agents, color stabilizers, demulsifiers, wetting agents, water loss improving agents, bactericides, drill bit lubricants, thickeners or gellants, anti-emulsifying agents, metal deactivators, coupling agents, surfactants, and additive solubilizers.

The present invention also includes a unique process for producing complex alcohol ester with low metal catalyst content and a low total acid number which comprises the steps of: (a) reacting a polyhydroxyl compound, a polybasic acid or an anhydride of a polybasic acid, and a monohydric alcohol at temperatures and pressures capable of causing the esterification of the reaction mixture; (b) adding a metal catalyst to the reaction mixture to form a crude complex alcohol ester product; and (c) hydrolyzing the crude complex alcohol ester product in the presence of between about 0.5 to 4 wt. % water, preferably 2 to 3 wt. %, based on the crude complex alcohol ester product, at a temperature of between about 100° to 200° C., preferably between about 110° to 175° C., and most preferably between about 125° to 160° C., and a pressure greater than 1 atmosphere, thereby producing a complex alcohol ester. The process may also include the steps of: (d) adding at least one adsorbent to the reaction mixture following esterification; (e) removing water used in hydrolysis step (c) by heat and vacuum in a flash step; (f) filtering solids from the esterified reaction mixture; (g) removing excess alcohol by steam stripping or any other distillation method; and (h) removing residual solids from the stripped ester in a final -filtration.

If the temperature at which the above hydrolysis takes place exceeds 200° C., then unacceptable TAN levels appear. If, however, the temperature at which hydrolysis takes place is less than 100° C., then hydrolysis of the metal catalyst does not fully occur and the metal catalyst content exceeds 25 ppm which is commercially undesirable.

DESCRIPTION OF THE PREFERRED EMBODIMENTS

Figure 1:
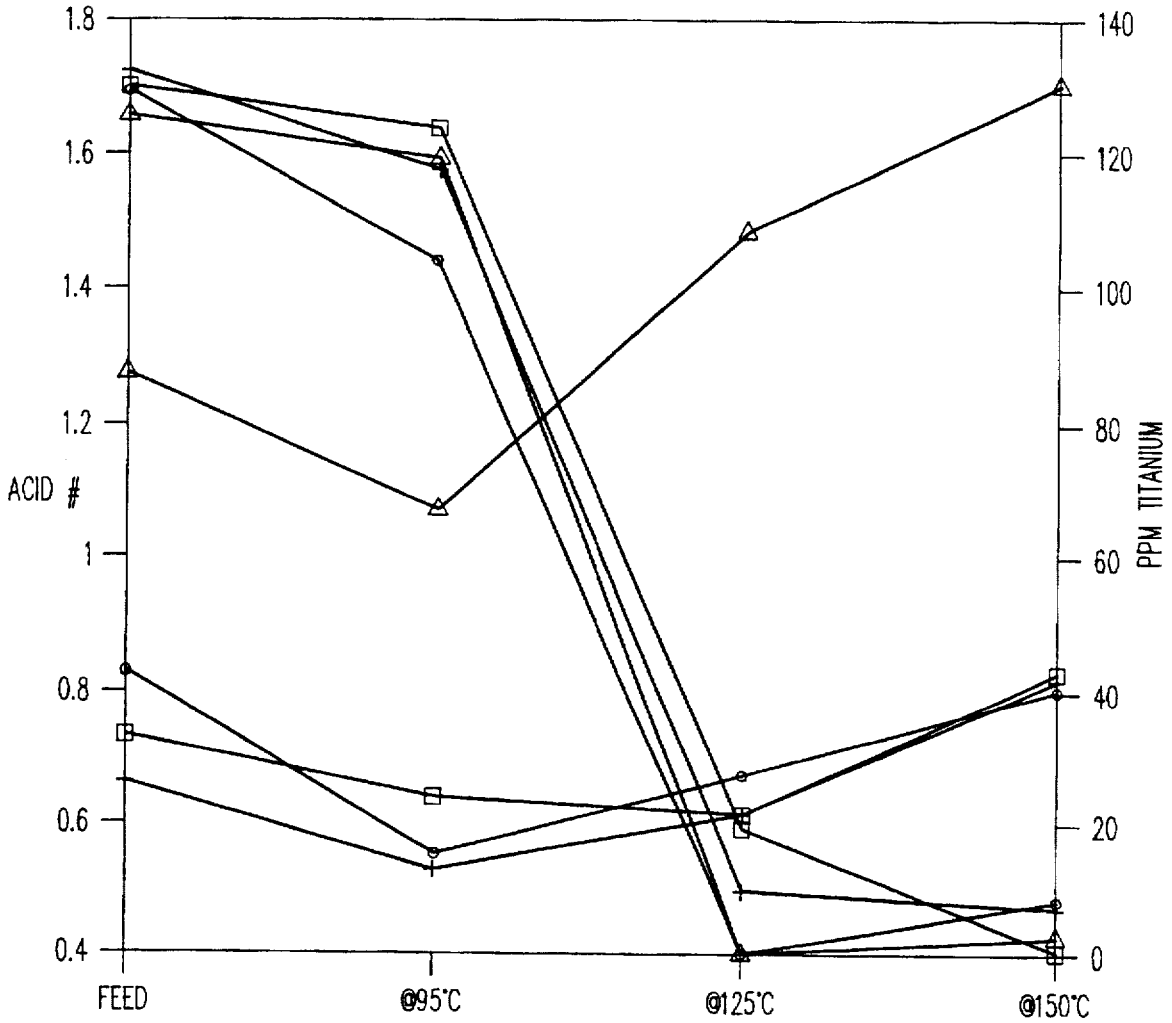
FIG. 1 is a graph plotting both total acid number (TAN) and titanium content versus hydrolysis temperature.

Complex alcohol esters provide a unique level of biodegradability, in conjunction with effective lubricating properties. They also provide excellent stability, high viscosity, low toxicity, friction modification, seal compatibility, and polarity.

The complex alcohol ester according to the present invention comprises the reaction product of an add mixture of the following: a polyhydroxyl compound represented by the general formula:

$$R(OH)_n$$

wherein R is any aliphatic or cyclo-aliphatic hydrocarbyl group and n is at least 2, provided that the hydrocarbyl group contains from about 2 to 20 carbon atoms; a polybasic acid or an anhydride of a polybasic acid, provided that the ratio of equivalents of the polybasic acid to equivalents of alcohol from the polyhydroxyl compound is in the range between about 1.6:1 to 2:1; and a monohydric alcohol, provided that the ratio of equivalents of the monohydric alcohol to equivalents of the polybasic acid is in the range between about 0.84:1 to 1.2:1; wherein the complex alcohol ester exhibits a pour point of less than or equal to −20° C., a viscosity in the range between about 100–700 cSt at 40° C. and having a polybasic acid ester concentration of less than or equal to 70 wt. %, based on the complex alcohol ester.

The present inventors have unexpectedly discovered that if the ratio of polybasic acid to polyol (i.e., polyhydroxyl compound) is too low, then an unacceptable amount of cross-linking occurs which results in very high viscosities, poor low temperature properties, poor biodegradability, and poor compatibility with other basestocks and with additives. If, however, the ratio of polybasic acid to polyol is too high, then an unacceptable amount of polybasic acid ester (e.g., adipate di-ester) is formed resulting in poor seal compatibility and low viscosity which limits the complex alcohol ester's applicability.

The complex alcohol ester also exhibits the following properties: seal swell less than (diisotridecyladipate) DTDA, viscosity at −25° C. less than or equal to 150,000 cps, flash point greater than 450° C., aquatic toxicity of less than 1,000 ppm, a specific gravity of less than 1.0, a viscosity index of less than 150 and HPDSC at 220° C. of greater than about 10 minutes. Trimethylolpropane (TMP) ester typically have a viscosity at −25° C. less than or equal to 50,000 cps.

The present inventors have also discovered that if the ratio of monohydric alcohol to polybasic acid is too low, i.e., less than 0.96 to 1, then an unacceptably high acid number, sludge concentration, deposits, and corrosion occur. If, however, the ratio of monohydric alcohol to polybasic acid is too high (i.e., 1.2 to 1), then an unacceptable amount of polybasic acid ester is formed resulting in poor seal compatibility and low viscosity which limits the complex alcohol ester's applicability.

This complex alcohol ester exhibits lubricity, as measured by the coefficient of friction, of less than or equal to 0.1 and is at least about 60% biodegradable as measured by the Sturm test.

It is preferable that the polybasic acid is adipic acid and the branched monohydric alcohol is in the range of $C_5$ to $C_{13}$, more preferably between about $C_8$ to $C_{10}$, e.g., isodecyl alcohol or 2-ethylhexanol.

The complex alcohol ester of the present invention exhibits at least one of the following additional properties selected from the group consisting of: a total acid number of less than or equal to about 1.0 mgKOH/gram, a hydroxyl number of greater than or in the range between about 0–50 mgKOH/gram, a metal catalyst content of less than about 10 ppm, a molecular weight in the range between about 275 to 250,000 Daltons, a seal swell equal to about DTDA (diisotridecyladipate), a viscosity at −25° C. of less than or equal to about 100,000 cps, a flash point of greater than about 200° C., aquatic toxicity of greater than about 1,000 ppm, a specific gravity of less than about 1.0, a viscosity index equal to or greater than about 150, and an oxidative and thermal stability as measured by HPDSC at 220° C. of greater than about 10 minutes.

When the polyhydroxyl compound is selected from the group consisting of technical grade pentaerythritol and mono-pentaerythritol the ratio of equivalents of the polybasic acid to equivalents of alcohol from the polyhydroxyl compound is in the range between about 1.75:1 to 2:1; and a monohydric alcohol, provided that the ratio of equivalents of the monohydric alcohol to equivalents of the polybasic acid is in the range between about 0.84:1 to 1.2:1; wherein the complex alcohol ester exhibits a pour point of less than or equal to −20° C., a viscosity in the range between about 100–700 cSt at 40° C. and having a low polybasic acid ester concentration of less than or equal to 70 wt. %, based on the complex alcohol ester.

Another preferred complex alcohol ester according to the present invention comprises the reaction product of: a polyol selected from the group consisting of: trimethylolpropane, trimethylolethane and trimethylolbutane; a polybasic acid or an anhydride of a polybasic acid, provided that the ratio of equivalents of the polybasic acid to equivalents of alcohol from the polyhydroxyl compound is in the range between about 1.6:1 to 2:1; and a monohydric alcohol, provided that the ratio of equivalents of the monohydric alcohol to equivalents of the polybasic acid is in the range between about 0.84:1 to 1.2:1; wherein the complex alcohol ester exhibits a pour point of less than or equal to −20° C., a viscosity in the range between about 100–700 cSt at 40° C. and having a low polybasic acid ester concentration of less than or equal to 70 wt. %, based on the complex alcohol ester.

The complex alcohol ester also exhibits the following properties: seal swell less than (diisotridecyladipate) DTDA, viscosity at −25° C. less than or equal to 150,000 cps, flash point greater than 450° C., aquatic toxicity of less than 1,000 ppm, a specific gravity of less than 1.0, a viscosity index of less than 150 and HPDSC at 220° C. of greater than about 10 minutes. Trimethylolpropane (TMP) ester typically have a viscosity at −25° C. less than or equal to 50,000 cps.

Still another complex alcohol ester according to the present invention comprises the reaction product of: a polyol of di-pentaerythritol; a polybasic acid or an anhydride of a polybasic acid, provided that the ratio of equivalents of the polybasic acid to equivalents of alcohol from the polyhydroxyl compound is in the range between about 1.83:1 to 2:1; and a monohydric alcohol, provided that the ratio of equivalents of the monohydric alcohol to equivalents of the polybasic acid is in the range between about 0.84:1 to 1.2:1; wherein the complex alcohol ester exhibits a pour point of less than or equal to −20° C., a viscosity in the range between about 100–700 cSt at 40° C. and having a low polybasic acid ester concentration of less than or equal to 70 wt. %, based on the complex alcohol ester.

Complex alcohol esters are produced by the esterification of polyols with dibasic acids and "end-capped" with monohydric alcohols in either single step or two step reactions. Catalysts are typically used to achieve greater than 99% conversion of the acid functionality present. Metal catalysts are preferred for several reasons, but have a disadvantage in that metallic residues are left in the final product after conventional removal techniques are used. The processes proposed herein use metal catalysts, but avoid the presence of significant amounts of metals in the final product and maintaining a low TAN, by either (1) adding the catalyst to the reaction between about 88 to 92% conversion of the polybasic acid is achieved rather than at the start of the reaction or, preferably, (2) treating the crude esterification product (after 99.8% of the hydroxyl functionalities are esterified) with water in an amount of between about 0.5 to 4 wt. %, based on crude esterification product, more preferably between about 2 to 3 wt. %, at elevated temperatures of between about 100° to 200° C., more preferably between about 110° to 175° C., and most preferably between about 125° to 160° C., and pressures greater than one atmosphere.

The process used to form the complex alcohol ester according to the present invention includes the following steps wherein a polyol and monohydric alcohol are reacted with a polycarboxylic (polybasic) acid or an anhydride of a polycarboxylic acid. For each hydroxyl group on the polyol, approximately one mole of polycarboxylic acid is used in the reaction mixture. Enough monohydric alcohol (e.g., less than 20% excess, more preferably between about 5–15% excess, is used to react with all of the carboxylic acid groups ignoring that the polyol also reacts with these acid groups. For a given polyol having 'X' equivalents of hydroxyls to moles, we use '2X' equivalents of acid groups and up to 1.2 equivalents of monohydric alcohol. The esterification reaction can take place with or without a sulfuric acid, phosphorus acid, sulfonic acid, para-toluene sulfonic acid or titanium, zirconium or tin-based catalyst, at a temperature in the range between about 140° to 250° C. and a pressure in the range between about 30 mm Hg to 760 mm Hg (3.999 to 101.308 kPa) for about 0.1 to 16 hours, preferably 2 to 12 hours, most preferably 6 to 8 hours. The stoichiometry in the reactor is variable, and vacuum stripping of excess alcohol generates the preferred final composition.

Optional steps include the following:

(a) addition of adsorbents such as alumina, silica gel, activated carbon, clay and/or filter aid to the reaction mixture following esterification before further treatment, but in certain cases clay treatment may occur later in the process following either flash drying or steam or nitrogen stripping and in still other cases the clay may be eliminated from the process altogether;

(b) addition of water in an amount of between about 0.5 to 4 wt. %, based on crude esterification product, more preferably between about 2 to 3 wt. %, to hydrolyze the catalyst at elevated temperatures of between about 100° to 200° C., more preferably between about 110° to 175° C., and most preferably between about 125° to 160° C., and pressures greater than one atmosphere, optionally, base to neutralize the residual organic and inorganic acids, and, optionally, addition of activated carbon and/or filter aids during hydrolysis;

(c) removal of the water used in the hydrolysis step by heat and vacuum in a flash step;

(d) filtration of solids from the ester mixture containing the bulk of the excess alcohol used in the esterification reaction;

(e) removal of excess alcohol by steam stripping or any other distillation method and recycling of the alcohol within the esterification process; and (f) removing any residual solids from the stripped ester in a final filtration.

The esterification process as described above allows for the formation of an ester product having low metals (i.e., approximately less than 25 ppm metals (10 ppm if the metal is titanium) based on the total ester product, low ash (i.e., approximately less than 15 ppm ash based on the total ester product), and low total acid number (TAN) (i.e., approximately less than or equal to 1.0 mgKOH/gram).

It is also desirable to form a complex alcohol ester using the one-step esterification process set forth above having an average molecular weight in the range between about 300 to greater than 25,000 Daltons (atomic weight units), preferably up to 250,000 Daltons.

When it is desirable to use esterification catalysts, titanium, zirconium and tin-based catalysts such as titanium, zirconium and tin alcoholates, carboxylates and chelates are preferred. See U.S. Pat. No. 3,056,818 (Werber) and U.S. Pat. No. 5,324,853 (Jones et al.) which disclose various specific catalysts which may be used in the esterification process of the present invention and which are incorporated herein by reference. It is also possible to use sulfuric acid, phosphorus acid, sulfonic acid and para-toluene sulfonic acid as the esterification catalyst, although they are not as preferred as the metal catalysts discussed immediately above, since they are very difficult to remove by conventional methods from this product.

It is particularly desirable to be able to control the stoichiometry in such a case so as to be able to manufacture the same product each time. Further, one wants to obtain acceptable reaction rates and to obtain high conversion with low final acidity and low final metals content. The present inventors have synthesized a composition and a method of production of that composition which provides a high viscosity oil having good low temperature properties, low metals, low acidity, high viscosity index, and acceptable rates of biodegradability as measured by the Sturm test.

One preferred manufacturing process using a batch process is as follows: (1) charge a polyol, polybasic acid and monohydric alcohol into an esterification reactor; (2) raise the temperature of the reacting mass to 220° C., while reducing vacuum to cause the alcohol present to boil and then separating water from the overhead vapor stream and returning alcohol to the reactor; (3) add tetraisopropyl titanate catalyst to the reacting mixture when 88 to 92% of the acid functionalities present in polybasic acid have been esterified; (4) continue reaction to about 99% conversion or other desired level of conversion of the acid functionalities present in polybasic acid; (5) stop the reaction by removing vacuum and heat; (6) carbon treat the product, if necessary to reduce its color; (7) hydrolyze titanium catalyst in the crude reactor product with about 0.5 to 4 wt. % water at a temperature in the range between about 100° to 200° C. and a pressure of above 1 atmosphere; (8) filter the titanium catalyst residue and carbon, if present; and (9) strip unreacted excess monohydric alcohol from the crude product.

The present inventors have discovered that under certain highly specific conditions, the amount of titanium in the product can be reduced to a level below 10 ppm using the above process. The process employed to make low residual titanium complex alcohol esters requires a minimum residence time of titanium in the reactor at certain temperatures (ca. 220° C.), the minimum amount of titanium catalyst required to assure the required conversion levels, and very effective contacting and mixing with the hydrolysis water solution employed to convert the organo titanium species to insoluble titanium dioxide.

Alternatively, if a product completely free of metals is desired, the process can be terminated at some conversion without the use of a catalyst (e.g., at 90% or greater conversion).

Of particular interest is the use of certain oxo-alcohols as finishing alcohols in the process of production of the desired materials. Oxo alcohols are manufactured via a process, whereby propylene and other olefins are oligomerized over a catalyst (e.g., a phosphoric acid on Kieselguhr clay) and then distilled to achieve various unsaturated (olefinic) streams largely comprising a single carbon number. These streams are then reacted under hydroformylation conditions using a cobalt carbonyl catalyst with synthesis gas (carbon monoxide and hydrogen) so as to produce a multi-isomer mix of aldehydes/alcohols. The mix of aldehydes/alcohols is then introduced to a hydrogenation reactor and hydrogenated to a mixture of branched alcohols comprising mostly alcohols of one carbon greater than the number of carbons in the feed olefin stream.

One particularly preferred oxo-alcohol is isodecyl alcohol, prepared from the corresponding $C_9$ olefin. When the alcohol is isodecyl alcohol, the polyol is trimethylolpropane and the acid is the $C_6$ diacid, e.g. adipic acid, a preferred complex alcohol ester is attained. The present inventors have surprisingly discovered that this complex alcohol ester, wherein the alcohol is a branched oxo-alcohol has a surprisingly high viscosity index of ca. 150 and is surprisingly biodegradable as defined by the Modified Sturm test. This complex alcohol ester can be prepared with a final acidity (TAN) of less than 1.0 mg KOH/gram and with a conversion of the adipic acid of greater than 99%. In order to achieve such a high conversion of adipic acid in acceptable reaction times, a catalyst is required, and further, it is preferable to add the catalyst within a relatively narrow conversion window. Alternatively, the present inventors have discovered that the catalyst can also be added at anytime during the reaction product and removed to an amount of less than 25 ppm (10 ppm in the instance where titanium is used) and still obtain a final acidity (TAN) of less than 1.0 mg KOH/gram, so long as the esterification reaction is followed by a hydrolysis step wherein water is added in an amount of between about 0.5 to 4 wt. %, based on crude esterification product, more preferably between about 2 to 3 wt. %, at elevated temperatures of between about 100° to 200° C., more preferably between about 110° to 175° C., and most preferably between about 125° to 160° C., and pressures greater than one atmosphere. Such high temperature hydrolysis can successfully remove the metals to less than 25 ppm without increasing the TAN to greater than 1.0 mgKOH/gram. The low metals and low acid levels achieved by use of this novel high temperature hydrolysis step is completely unexpected.

The present inventors have also discovered that the actual product is a broad mix of molecular weights of esters and that, if so desired, an amount of diisodecyl adipate can be removed from the higher molecular weight ester via wipe film evaporation or other separation techniques if desired.

It is known that when titanium catalysts (or other metal catalysts such as tin) are used in the manufacture of a sterically hindered, crowded neopolyol ester, removal of the metal via hydrolysis is difficult to achieve. Thus, for example, when titanium is added prior to approximately 90% conversion of the polybasic acid without high temperature hydrolysis, then significant levels, i.e., greater than 10 ppm, of titanium metal are typically found in the final product even after extensive efforts to hydrolyze the organic titanium to titanium dioxide at conventional hydrolysis temperatures and subsequent removal via filtration.

MONOHYDRIC ALCOHOLS

Among the alcohols which can be reacted with the diacid and polyol are, by way of example, any $C_5$ to $C_{13}$ branched and/or linear monohydric alcohol selected from the group consisting of: isopentyl alcohol, n-pentyl alcohol, isoheptyl alcohol, n-heptyl alcohol, iso-octyl alcohol (e.g., either 2-ethyl hexanol or Cekanoic 8), n-octyl alcohol, iso-nonyl alcohol (e.g., 3,5,5-trimethyl-1-hexanol or Cekanoic 9), n-nonyl alcohol, isodecyl alcohol, and n-decyl alcohol; provided that the amount of linear monohydric alcohol is present in the range between about 0–20 mole %, based on the total amount of monohydric alcohol (i.e., the ratio of equivalents of monohydric alcohol to equivalents of polybasic acid is in the range of between 0.84:1 to 1.2:1). The preferred range of alcohol are $C_8$ to $C_{10}$ branched and/or linear monohydric alcohols.

One preferred class of monohydric alcohol is oxo alcohol. Oxo alcohols are manufactured via a process, whereby propylene and other olefins are oligomerized over a catalyst (e.g., a phosphoric acid on Kieselguhr clay) and then distilled to achieve various unsaturated (olefinic) streams largely comprising a single carbon number. These streams are then reacted under hydroformylation conditions using a cobalt carbonyl catalyst with synthesis gas (carbon monoxide and hydrogen) so as to produce a multi-isomer mix of aldehydes/alcohols. The mix of aldehydes/alcohols is then introduced to a hydrogenation reactor and hydrogenated to a mixture of branched alcohols comprising mostly alcohols of one carbon greater than the number of carbons in the feed olefin stream.

The branched oxo alcohols are preferably monohydric oxo alcohols which have a carbon number in the range between about $C_5$ to $C_{13}$. The most preferred monohydric oxo alcohols according to the present invention include iso-oxo octyl alcohol, e.g., Cekanoic 8 alcohol, formed from the cobalt oxo process and 2-ethylhexanol which is formed from the rhodium oxo process.

The term "iso" is meant to convey a multiple isomer product made by the oxo process. It is desirable to have a branched oxo alcohol comprising multiple isomers, preferably more than 3 isomers, most preferably more than 5 isomers.

Branched oxo alcohols may be produced in the so-called "oxo" process by hydroformylation of commercial branched $C_4$ to $C_{12}$ olefin fractions to a corresponding branched $C_5$ to $C_{13}$ alcohol/aldehyde-containing oxonation product. In the process for forming oxo alcohols it is desirable to form an alcohol/aldehyde intermediate from the oxonation product followed by conversion of the crude oxo alcohol/aldehyde product to an all oxo alcohol product.

The production of branched oxo alcohols from the cobalt catalyzed hydroformylation of an olefinic feedstream preferably comprises the following steps:

(a) hydroformylating an olefinic feedstream by reaction with carbon monoxide and hydrogen (i.e., synthesis gas) in the presence of a hydroformylation catalyst under reaction conditions that promote the formation of an alcohol/aldehyde-rich crude reaction product;

(b) demetalling the alcohol/aldehyde-rich crude reaction product to recover therefrom the hydroformylation catalyst and a substantially catalyst-free, alcohol/aldehyde-rich crude reaction product; and (c) hydrogenating the alcohol/aldehyde-rich crude reaction product in the presence of a hydrogenation catalyst (e.g., massive nickel catalyst) to produce an alcohol-rich reaction product.

The olefinic feedstream is preferably any $C_4$ to $C_{12}$ olefin, more preferably branched $C_7$ to $C_9$ olefins. Moreover, the olefinic feedstream is preferably a branched olefin, although a linear olefin which is capable of producing all branched oxo alcohols is also contemplated herein. The hydroformylation and subsequent hydrogenation in the presence of an alcohol-forming catalyst, is capable of producing branched $C_5$ to $C_{13}$ alcohols, more preferably branched $C_8$ alcohol (i.e., Cekanoic 8), branched $C_9$ alcohol (i.e., Cekanoic 9) and iso-decyl alcohol. Each of the branched oxo $C_5$ to $C_{13}$ alcohols formed by the oxo process typically comprises, for example, a mixture of branched oxo alcohol isomers, e.g., Cekanoic 8 alcohol comprises a mixture of 3,5-dimethyl hexanol, 4,5-dimethyl hexanol, 3,4-dimethyl hexanol, 5-methyl heptanol, 4-methyl heptanol and a mixture of other methyl heptanols and dimethyl hexanols.

Any type of catalyst known to one of ordinary skill in the art which is capable of converting oxo aldehydes to oxo alcohols is contemplated by the present invention.

POLYOLS

Among the polyols (i.e., polyhydroxyl compounds) which can be reacted with the diacid and monohydric alcohol are those represented by the general formula:

$$R(OH)_n$$

wherein R is any aliphatic or cyclo-aliphatic hydrocarbyl group (preferably an alkyl) and n is at least 2. The hydrocarbyl group may contain from about 2 to about 20 or more carbon atoms, and the hydrocarbyl group may also contain substituents such as chlorine, nitrogen and/or oxygen atoms. The polyhydroxyl compounds generally may contain one or more oxyalkylene groups and, thus, the polyhydroxyl compounds include compounds such as polyetherpolyols. The number of carbon atoms (i.e., carbon number, wherein the term carbon number as used throughout this application refers to the total number of carbon atoms in either the acid or alcohol as the case may be) and number of hydroxy groups (i.e., hydroxyl number) contained in the polyhydroxyl compound used to form the carboxylic esters may vary over a wide range.

The following alcohols are particularly useful as polyols: neopentyl glycol, trimethylolethane, trimethylolpropane, trimethylolbutane, mono-pentaerythritol, technical grade pentaerythritol, and di-pentaerythritol. The most preferred alcohols are technical grade (e.g., approximately 88% mono-, 10% di- and 1–2% tri-pentaerythritol) pentaerythritol, monopentaerythritol, di-pentaerythritol, and trimethylolpropane.

POLYBASIC ACIDS

Selected polybasic or polycarboxylic acids include any $C_2$ to $C_{12}$ diacids, e.g., adipic, azelaic, sebacic and dodecanedioic acids.

ANHYDRIDES

Anhydrides of polybasic acids can be used in place of the polybasic acids, when esters are being formed. These include succinic anhydride, glutaric anhydride, adipic anhydride, maleic anhydride, phthalic anhydride, trimellitic anhydride, nadic anhydride, methyl nadic anhydride, hexahydrophthalic anhydride, and mixed anhydrides of polybasic acids.

The complex alcohol ester composition according to the present invention can be used in the formulation of various lubricants, such as, crankcase engine oils (i.e., passenger car motor oils, heavy duty diesel motor oils, and passenger car diesel oils), two-cycle engine oils, catapult oil, hydraulic fluids, drilling fluids, aircraft and other turbine oils, greases, compressor oils, functional fluids, gear oils, and other industrial and engine lubrication applications. The lubricating oils contemplated for use with the complex alcohol ester compositions of the present invention include both mineral and synthetic hydrocarbon oils of lubricating viscosity and mixtures thereof with other synthetic oils. The synthetic hydrocarbon oils include long chain alkanes such as cetanes and olefin polymers such as oligomers of hexene, octene, decene, and dodecene, etc. The other synthetic oils include (1) fully esterified ester oils, with no free hydroxyls, such as pentaerythritol esters of monocarboxylic acids having 2 to 20 carbon atoms, trimethylol propane esters of monocarboxylic acids having 2 to 20 carbon atoms, (2) polyacetals and (3) siloxane fluids. Especially useful among the synthetic esters are those made from polycarboxylic acids and monohydric alcohols.

In some of the lubricant formulations set forth above a solvent may be employed depending upon the specific application. Solvents that can be used include the hydrocarbon solvents, such as toluene, benzene, xylene, and the like.

The formulated lubricant according to the present invention preferably comprises about 60–99% by weight of at least one polyol ester composition of the present invention, about 1 to 20% by weight lubricant additive package, and about 0 to 20% by weight of a solvent.

CRANKCASE LUBRICATING OILS

The complex alcohol ester composition can be used in the formulation of crankcase lubricating oils (i.e., passenger car motor oils, heavy duty diesel motor oils, and passenger car diesel oils) for spark-ignited and compression-ignited engines. The preferred crankcase lubricating oil is typically formulated using the complex alcohol ester formed according to the present invention or such an ester blended with other conventional basestock oils, together with any conventional crankcase additive package. The additives listed below are typically used in such amounts so as to provide their normal attendant functions. Typical amounts for individual components are also set forth below. All the values listed are stated as mass percent active ingredient.

| ADDITIVE | MASS % (Broad) | MASS % (Preferred) |
|---|---|---|
| Ashless Dispersant | 0.1–20 | 1–8 |
| Metal detergents | 0.1–15 | 0.2–9 |
| Corrosion Inhibitor | 0–5 | 0–1.5 |
| Metal dihydrocarbyl dithiophosphate | 0.1–6 | 0.1–4 |
| Supplemental anti-oxidant | 0–5 | 0.01–1.5 |
| Pour Point Depressant | 0.01–5 | 0.01–1.5 |
| Anti-Foaming Agent | 0–5 | 0.001–0.15 |

-continued

| ADDITIVE | MASS % (Broad) | MASS % (Preferred) |
|---|---|---|
| Supplemental Anti-wear Agents | 0–0.5 | 0–0.2 |
| Friction Modifier | 0–5 | 0–1.5 |
| Viscosity Modifier[1] | 0.01–6 | 0–4 |
| Synthetic Basestock | Balance | Balance |

The individual additives may be incorporated into a basestock in any convenient way. Thus, each of the components can be added directly to the basestock by dispersing or dissolving it in the basestock at the desired level of concentration. Such blending may occur at ambient temperature or at an elevated temperature.

Preferably, all the additives except for the viscosity modifier and the pour point depressant are blended into a concentrate or additive package described herein as the additive package, that is subsequently blended into basestock to make finished lubricant. Use of such concentrates is conventional. The concentrate will typically be formulated to contain the additive(s) in proper amounts to provide the desired concentration in the final formulation when the concentrate is combined with a predetermined amount of base lubricant.

The concentrate is preferably made in accordance with the method described in U.S. Pat. No. 4,938,880. That patent describes making a pre-mix of ashless dispersant and metal detergents that is pre-blended at a temperature of at least about 100° C. Thereafter, the pre-mix is cooled to at least 85° C. and the additional components are added.

The final crankcase lubricating oil formulation may employ from 2 to 15 mass % and preferably 5 to 10 mass %, typically about 7 to 8 mass % of the concentrate or additive package with the remainder being basestock.

The ashless dispersant comprises an oil soluble polymeric hydrocarbon backbone having functional groups that are capable of associating with particles to be dispersed. Typically, the dispersants comprise amine, alcohol, amide, or ester polar moieties attached to the polymer backbone often via a bridging group. The ashless dispersant may be, for example, selected from oil soluble salts, esters, aminoesters, amides, imides, and oxazolines of long chain hydrocarbon substituted mono and dicarboxylic acids or their anhydrides; thiocarboxylate derivatives of long chain hydrocarbons; long chain aliphatic hydrocarbons having a polyamine attached directly thereto; and Mannich condensation products formed by condensing a long chain substituted phenol with formaldehyde and polyalkylene polyamine.

The viscosity modifier (VM) functions to impart high and low temperature operability to a lubricating oil. The VM used may have that sole function, or may be multifunctional.

Multifunctional viscosity modifiers that also function as dispersants are also known. Suitable viscosity modifiers are polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, inter polymers of styrene and acrylic esters, and partially hydrogenated copolymers of styrene/ isoprene, styrene/butadiene, and isoprene/butadiene, as well as the partially hydrogenated homopolymers of butadiene and isoprene and isoprene/divinylbenzene.

Metal-containing or ash-forming detergents function both as detergents to reduce or remove deposits and as acid neutralizers or rust inhibitors, thereby reducing wear and corrosion and extending engine life. Detergents generally comprise a polar head with a long hydrophobic tail, with the polar head comprising a metal salt of an acidic organic compound. The salts may contain a substantially stoichiometric amount of the metal in which case they are usually described as normal or neutral salts, and would typically have a total base number or TBN (as may be measured by ASTM D2896) of from 0 to 80. It is possible to include large amounts of a metal base by reacting an excess of a metal compound such as an oxide or hydroxide with an acidic gas such as carbon dioxide. The resulting overbased detergent comprises neutralized detergent as the outer layer of a metal base (e.g. carbonate) micelle. Such overbased detergents may have a TBN of 150 or greater, and typically of from 250 to 450 or more.

Detergents that may be used include oil-soluble neutral and overbased sulfonates, phenates, sulfurized phenates, thiophosphonates, salicylates, and naphthenates and other oil-soluble carboxylates of a metal, particularly the alkali or alkaline earth metals, e.g., sodium, potassium, lithium, calcium, and magnesium. The most commonly used metals are calcium and magnesium, which may both be present in detergents used in a lubricant, and mixtures of calcium and/or magnesium with sodium. Particularly convenient metal detergents are neutral and overbased calcium sulfonates having TBN of from 20 to 450 TBN, and neutral and overbased calcium phenates and sulfurized phenates having TBN of from 50 to 450.

Dihydrocarbyl dithiophosphate metal salts are frequently used as anti-wear and antioxidant agents. The metal may be an alkali or alkaline earth metal, or aluminum, lead, tin, molybdenum, manganese, nickel or copper. The zinc salts are most commonly used in lubricating oil in amounts of 0.1 to 10, preferably 0.2 to 2 wt. %, based upon the total weight of the lubricating oil composition. They may be prepared in accordance with known techniques by first forming a dihydrocarbyl dithiophosphoric acid (DDPA), usually by reaction of one or more alcohol or a phenol with $P_2S_5$ and then neutralizing the formed DDPA with a zinc compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt any basic or neutral zinc compound could be used but the oxides, hydroxides and carbonates are most generally employed. Commercial additives frequently contain an excess of zinc due to use of an excess of the basic zinc compound in the neutralization reaction.

Oxidation inhibitors or antioxidants reduce the tendency of basestocks to deteriorate in service which deterioration can be evidenced by the products of oxidation such as sludge and varnish-like deposits on the metal surfaces and by viscosity growth. Such oxidation inhibitors include hindered phenols, alkaline earth metal salts of alkylphenolthioesters having preferably $C_5$ to $C_{12}$ alkyl side chains, calcium nonylphenol sulfide, ashless oil soluble phenates and sulfurized phenates, phosphosulfurized or sulfurized hydrocarbons, phosphorous esters, metal thiocarbamates, oil soluble copper compounds as described in U.S. Pat. No. 4,867,890, and molybdenum containing compounds.

Friction modifiers may be included to improve fuel economy. Oil-soluble alkoxylated mono- and diamines are well known to improve boundary layer lubrication. The amines may be used as such or in the form of an adduct or reaction product with a boron compound such as a boric oxide, boron halide, metaborate, boric acid or a mono-, di- or trialkyl borate.

Other friction modifiers are known. Among these are esters formed by reacting carboxylic acids and anhydrides with alkanols. Other conventional friction modifiers generally consist of a polar terminal group (e.g. carboxyl or hydroxyl) covalently bonded to an oleophillic hydrocarbon chain. Esters of carboxylic acids and anhydrides with alkanols are described in U.S. Pat. No. 4,702,850. Examples of other conventional friction modifiers are described by M. Belzer in the "Journal of Tribology" (1992), Vol. 114, pp. 675–682 and M. Belzer and S. Jahanmir in "Lubrication Science" (1988), Vol. 1, pp. 3–26.

Rust inhibitors selected from the group consisting of nonionic polyoxyalkylene polyols and esters thereof, polyoxyalkylene phenols, and anionic alkyl sulfonic acids may be used.

Copper and lead bearing corrosion inhibitors may be used, but are typically not required with the formulation of the present invention. Typically such compounds are the thiadiazole polysulfides containing from 5 to 50 carbon atoms, their derivatives and polymers thereof. Derivatives of 1,3,4 thiadiazoles such as those described in U.S. Pat. Nos. 2,719,125; 2,719,126; and 3,087,932; are typical. Other similar materials are described in U.S. Pat. Nos. 3,821,236; 3,904,537; 4,097,387; 4,107,059; 4,136,043; 4,188,299; and 4,193,882. Other additives are the thio and polythio sulfenamides of thiadiazoles such as those described in UK. Patent Specification No. 1,560,830. Benzotriazoles derivatives also fall within this class of additives. When these compounds are included in the lubricating composition, they are preferably present in an amount not exceeding 0.2 wt % active ingredient.

A small amount of a demulsifying component may be used. A preferred demulsifying component is described in EP 330,522. It is obtained by reacting an alkylene oxide with an adduct obtained by reacting a bis-epoxide with a polyhydric alcohol. The demulsifier should be used at a level not exceeding 0.1 mass % active ingredient. A treat rate of 0.001 to 0.05 mass % active ingredient is convenient.

Pour point depressants, otherwise known as lube oil flow improvers, lower the minimum temperature at which the fluid will flow or can be poured. Such additives are well known. Typical of those additives which improve the low temperature fluidity of the fluid are $C_8$ to $C_{18}$ dialkyl fumarate/vinyl acetate copolymers and polyalkylmethacrylates.

Foam control can be provided by many compounds including an antifoamant of the polysiloxane type, for example, silicone oil or polydimethyl siloxane.

Some of the above-mentioned additives can provide a multiplicity of effects; thus for example, a single additive may act as a dispersant-oxidation inhibitor. This approach is well known and does not require further elaboration.

TWO-CYCLE ENGINE OILS

The complex alcohol ester composition can be used in the formulation of two-cycle engine oils together with other basestocks and selected lubricant additives. The preferred two-cycle engine oil is typically formulated using the complex alcohol ester composition formed according to the present invention together with a lower viscosity basestock component and any conventional two-cycle engine oil additive package. The additives listed below are typically used in such amounts so as to provide their normal attendant functions. The additive package may include, but is not limited to, viscosity index improvers, corrosion inhibitors, oxidation inhibitors, coupling agents, dispersants, extreme pressure agents, color stabilizers, surfactants, diluents, detergents and rust inhibitors, pour point depressants, antifoaming agents, and anti-wear agents.

The two-cycle engine oil according to the present invention can employ typically about 5–15 wt. % complex alcohol ester, 60–80 wt. % low viscosity ester, and 5–20 wt. % low viscosity basestock, about 1 to 5% solvent, with the remainder comprising an additive package.

Examples of the above additives for use in lubricants are set forth in the following documents which are incorporated herein by reference: U.S. Pat. No. 4,663,063 (Davis), which issued on May 5, 1987; U.S. Pat. No. 5,330,667 (Tiffany, III et al.), which issued on Jul. 19, 1994; U.S. Pat. No. 4,740,321 (Davis et al.), which issued on Apr. 26, 1988; U.S. Pat. No. 5,321,172 (Alexander et al.), which issued on Jun. 14, 1994; and U.S. Pat. No. 5,049,291 (Miyaji et al.), which issued on Sep. 17, 1991.

CATAPULT OILS

Catapults are instruments used on aircraft carriers at sea to eject the aircraft off of the carrier. The complex alcohol ester composition can be used in the formulation of catapult oils together with other basestocks such as esters, polyalphaolefins, etc. and selected lubricant additives. The preferred catapult oil is typically formulated using the complex alcohol ester composition formed according to the present invention together with lower viscosity basestocks and any conventional catapult oil additive package. The additives listed below are typically used in such amounts so as to provide their normal attendant functions. The additive package may include, but is not limited to, viscosity index improvers, corrosion inhibitors, oxidation inhibitors, extreme pressure agents, color stabilizers, detergents and rust inhibitors, antifoaming agents, anti-wear agents, and friction modifiers. These additives are disclosed in Klamann, "Lubricants and Related Products", *Verlag Chemie*, Deerfield Beach, Fla., 1984, which is incorporated herein by reference.

The catapult oil according to the present invention can employ typically about 5–20 wt. % complex alcohol ester, 70–90 wt. % other basestocks, with the remainder comprising an additive package.

HYDRAULIC FLUIDS

The complex alcohol ester composition can be used in the formulation of hydraulic fluids together with selected lubricant additives. The preferred hydraulic fluids are typically formulated using the complex alcohol ester composition formed according to the present invention together with other basestocks any conventional hydraulic fluid additive package. The additives listed below are typically used in such amounts so as to provide their normal attendant functions. The additive package may include, but is not limited to, viscosity index improvers, corrosion inhibitors, boundary lubrication agents, demulsifiers, pour point depressants, and antifoaming agents.

The hydraulic fluid according to the present invention can employ typically about 10–90 wt. % complex alcohol ester, 0–90 wt. % other basestocks, with the remainder comprising an additive package.

Other additives are disclosed in U.S. Pat. No. 4,783,274 (Jokinen et al.), which issued on Nov. 8, 1988, and which is incorporated herein by reference.

DRILLING FLUIDS

The complex alcohol ester composition can be used in the formulation of drilling fluids together with other biodegradable basestocks and selected lubricant additives. The preferred drilling fluids are typically formulated using the complex alcohol ester composition formed according to the present invention together with any conventional drilling fluid additive package. The additives listed below are typically used in such amounts so as to provide their normal attendant functions. The additive package may include, but is not limited to, viscosity index improvers, corrosion inhibitors, wetting agents, water loss improving agents, bactericides, and drill bit lubricants.

The drilling fluid according to the present invention can employ typically about 60 to 90% basestock and about 5 to 25% solvent, with the remainder comprising an additive package. See U.S. Pat. No. 4,382,002 (Walker et al), which issued on May 3, 1983, and which is incorporated herein by reference.

Suitable hydrocarbon solvents include: mineral oils, particularly those paraffin base oils of good oxidation stability with a boiling range of from 200°–400° C. such as Mentor 28®, sold by Exxon Chemical Americas, Houston, Tex.; diesel and gas oils; and heavy aromatic naphtha.

TURBINE OILS

The complex alcohol ester composition can be used in the formulation of turbine oils together with selected lubricant additives. The preferred turbine oil is typically formulated using the complex alcohol ester composition formed according to the present invention together with any conventional turbine oil additive package. The additives listed below are typically used in such amounts so as to provide their normal attendant functions. The additive package may include, but is not limited to, viscosity index improvers, corrosion inhibitors, oxidation inhibitors, thickeners, dispersants, anti-emulsifying agents, color stabilizers, detergents and rust inhibitors, and pour point depressants.

The turbine oil according to the present invention can employ typically about 65 to 75% basestock and about 5 to 30% solvent, with the remainder comprising an additive package, typically in the range between about 0.01 to about 5.0 weight percent each, based on the total weight of the composition.

GREASES

The complex alcohol ester composition can be used in the formulation of greases together with selected lubricant additives. The main ingredient found in greases is the thickening agent or gellant and differences in grease formulations have often involved this ingredient. Besides the thickener or gellants, other properties and characteristics of greases can be influenced by the particular lubricating basestock and the various additives that can be used.

The preferred greases are typically formulated using the complex alcohol ester composition formed according to the present invention together with any conventional grease additive package. The additives listed below are typically used in such amounts so as to provide their normal attendant functions. The additive package may include, but is not limited to, viscosity index improvers, oxidation inhibitors, extreme pressure agents, detergents and rust inhibitors, pour point depressants, metal deactivators, anti-wear agents, and thickeners or gellants.

The grease according to the present invention can employ typically about 80 to 95% basestock and about 5 to 20% thickening agent or gellant, with the remainder comprising an additive package.

Typical thickening agents used in grease formulations include the alkali metal soaps, clays, polymers, asbestos, carbon black, silica gels, polyureas and aluminum complexes. Soap thickened greases are the most popular with lithium and calcium soaps being most common. Simple soap greases are formed from the alkali metal salts of long chain fatty acids with lithium 12-hydroxystearate, the predominant one formed from 12-hydroxystearic acid, lithium hydroxide monohydrate and mineral oil. Complex soap greases are also in common use and comprise metal salts of a mixture of organic acids. One typical complex soap grease found in use today is a complex lithium soap grease prepared from 12-hydroxystearic acid, lithium hydroxide monohydrate, azelaic acid and mineral oil.

The lithium soaps are described and exemplified in many patents including U.S. Pat. No. 3,758,407 (Harting), which issued on Sep. 11, 1973; U.S. Pat. No. 3,791,973 (Gilani), which issued on Feb. 12, 1974; and U.S. Pat. No. 3,929,651 (Murray), which issued on Dec. 30, 1975, all of which are incorporated herein by reference together with U.S. Pat. No. 4,392,967 (Alexander), which issued on Jul. 12, 1983.

A description of the additives used in greases may be found in Boner, "Modern Lubricating Greases", 1976, Chapter 5, which is incorporated herein by reference, as well as additives listed above in the other products.

COMPRESSOR OILS

The complex alcohol ester composition can be used in the formulation of compressor oils together with selected lubricant additives. The preferred compressor oil is typically formulated using the complex alcohol ester composition formed according to the present invention together with any conventional compressor oil additive package. The additives listed below are typically used in such amounts so as to provide their normal attendant functions. The additive package may include, but is not limited to, oxidation inhibitors, additive solubilizers, rust inhibitors/metal passivators, demulsifying agents, and anti-wear agents.

The compressor oil according to the present invention can employ typically about 80 to 99% basestock and about 1 to 15% solvent, with the remainder comprising an additive package.

The additives for compressor oils are also set forth in U.S. Pat. No. 5,156,759 (Culpon, Jr.), which issued on Oct. 20, 1992, and which is incorporated herein by reference.

GEAR OILS

The complex alcohol ester composition can be used in the formulation of gear oils together with selected lubricant additives. The preferred gear oil is typically formulated using the complex alcohol ester composition formed according to the present invention together with any conventional gear oil additive package. The additives listed below are typically used in such amounts so as to provide their normal attendant functions. The additive package may include, but is not limited to, extreme pressure agents and antiwear agents (i.e., friction modifiers), corrosion inhibitors, antifoam agents, demulsifiers, rust inhibitors and antioxidants. Depending on the basestock selected and multigrade viscosity range, pour-point depressants and viscosity modifiers may also be used.

The gear oil according to the present invention can employ typically about 72 to 99% basestock (preferably 90 to 99%) and 1 to 28% of an additive package (preferably 1 to 10%). Optionally, a solvent or diluent may also be added wherein the weight % of the basestock and/or additive package would be reduced accordingly.

It is extremely important in many lubricant applications such as aircraft turbine oils to provide a lubricant product which is thermally/oxidatively stable. One means of measuring relative thermal/oxidative stability in lubricants is via high pressure differential scanning calorimetry (HPDSC). In this test, the sample is heated to a fixed temperature and held there under a pressure of air (or oxygen) and the time to onset of decomposition is measured. The longer the time to decomposition, the more stable the sample. In all cases described hereafter, the conditions are as follows unless specifically noted otherwise: 220° C., 3.445 MPa (500 psi) air (i.e., 0.689 MPa (100 psi) oxygen and 2.756 MPa (400 psi) nitrogen), and the addition of 0.5 wt. % dioctyl diphenyl amine (Vanlube-81®) as an antioxidant.

In the reaction to form esters, the monohydric alcohol, a branched or unbranched $C_7$–$C_{13}$ alcohol (most preferably isodecyl alcohol) is typically present in an excess of about 10 to 50 mole % or more. The excess monohydric alcohol is used to force the reaction to completion. The composition of the feed acid is adjusted so as to provide the desired composition of the ester product. After the reaction is complete, the excess monohydric alcohol is removed by stripping and additional finishing.

EXAMPLE 1

A complex alcohol ester is formed according to the present invention by reacting 1.0 mole of trimethylol propane, 2.75 moles of adipic acid, and 3.025 moles of isodecyl alcohol. The temperature of the reaction mixture is raised to 220° C. while reducing the vacuum to cause the alcohol present to boil. Water is concurrently separated from the overhead vapor stream produced, and alcohol is returned to the reactor. Tetraisopropyl titanate catalyst is added to the reacting mixture when 90% of the acid functionalities present in the adipic acid have been esterified. The reaction is continued to 99.8% conversion of the acid functionalities present in adipic acid. The reaction is brought to a stop by removing the vacuum and heat. The product is carbon treated to reduce its color, and the titanium catalyst is hydrolyzed in the crude reactor product with 2 wt % water. The carbon and hydrolyzed titanium catalyst residue are filtered and unreacted excess isodecyl alcohol is stripped from the crude product. Accordingly, the amount of titanium in the product can be reduced to a level below 25 ppm using this process.

The resultant complex alcohol ester has a surprisingly high viscosity index of ca. 150 and is surprisingly biodegradable as defined by the Modified Sturm test. This complex alcohol ester has a final acidity (TAN) of less than 1.0 mg KOH/gram.

EXAMPLE 2

To produce a product according to the present invention that is substantially free of metals (i.e., less than 10 ppm), the process of Example 1 is employed, however the process is terminated at a conversion point (e.g. 98%) before the titanium catalyst is added according to Example 1.

EXAMPLE 3

Complex alcohol esters were prepared by reacting a polyol, a dicarboxylic acid, and 3,5,5-trimethyl-1-hexanol, in the molar ratios given in Table 3 below, in the presence of a catalyst. After reaction was complete, the catalyst was removed and excess alcohol stripped from the crude product. Filtering produced the final product.

TABLE 1

| Polyol | Dicarboxylic Acid | Alcohol | Molar Ratio | HPDSC (min.) |
|---|---|---|---|---|
| NPG | Adipic Acid | 3,5,5-trimethyl-1-hexanol | 1:2.0:2.64 | 5.6 |
| NPG | Adipic Acid | 3,5,5-trimethyl-1-hexanol | 1:2.3:3.38 | 44.3 |
| NPG | Adipic Acid | 3,5,5-trimethyl-1-hexanol | 1:1.75:2.6 | 48.9 |
| TMP | Adipic Acid | 3,5,5-trimethyl-1-hexanol | 1:3.0:3.9 | 76.9 |
| TMP | Adipic Acid | 3,5,5-trimethyl-1-hexanol | 1:3.3:3.9 | 76.9 |
| TMP | Adipic Acid | 3,5,5-trimethyl-1-hexanol | 1:2.63:3.89 | 66.7 |

NPG denote neopentyl glycol.
TMP denotes trimethylolpropane.

As the data set forth above demonstrate, complex alcohol esters exhibit exceptional oxidative stability as measured by HPDSC. They are significantly more stable than simple esters and most polyol esters.

EXAMPLE 4

Complex alcohol esters were made using both trimethylolpropane and technical grade pentaerythritol as the polyol, adipic acid as the polybasic acid and various $C_7$–$C_{13}$ monohydric alcohols, both linear and branched. During the reaction, the adipate di-ester was also formed. Some of these materials were wipefilmed to remove the adipate di-ester and some were not. The products were submitted for various tests.

One particularly surprising result was in regard to seal swell. Diisodecyladipate (DIDA) has been found to be particularly harsh on some seals. Samples containing as much as 40% DIDA demonstrated the same seal swell as samples of diisotridecyladipate (DTDA), which is used as a commercial lubricant today.

EXAMPLE 5

Table 3 below compares a variety of complex alcohols ester versus a conventional branched ester to demonstrate the increased biodegradability and thermal and oxidative stability of the complex alcohol esters according to the present invention.

The branched acid ester and the complex alcohol ester formed without stripping exhibited undesirable pour points, i.e., −20° and −14° C., respectively, and undesirable viscosities at −25° C., i.e., 358,000 cps and a solid product, respectively.

EXAMPLE 6

Set forth below in Table 4 are various samples where the complex alcohol esters of the present invention were blended with various other polyol esters and then run through a Yamaha 2T test.

TABLE 4

(Lubricity Data)

| Ester Blend | Blend Ratio | Torque Reference | Torque Sample |
|---|---|---|---|
| TPE/C810/Ck8:TMP/7810 | 1:1 | 6.00 | 5.92 |
| TMP/AA/IDA:TMP/1770 | 2:3 | 5.54 | 5.18 |

C810 is a mixture of linear $C_8$ and $C_{10}$ acids.
Ck8 is an iso-octyl alcohol form from the cobalt oxo process.
7810 is a blend of n-C7, C8 and C10 acids.
1770 is a blend of n-C7 and α-branched C7 acids.

Since less torque is better, the ester blend according to the present invention, i.e., TMP/AA/IDA:TMP/1770, demonstrated far superior torque than a blend of conventional ester basestocks.

EXAMPLE 7

High viscosity complex alcohol esters according to the present invention were synthesized by reacting one mole of trimethylolpropane with three moles of succinic anhydride and after they were fully reacted (as shown by exothermic heat increase) the resultant polybasic acid was esterified with excess isodecyl alcohol using titanium tetraisopropoxide as the esterification catalyst. The crude reactor provided was neutralized, flash dried, filtered and the excess isodecyl alcohol was stripped from the reactor product.

The finished complex alcohol ester composition had a specific gravity of 1.013, a viscosity of 260.9 cSt at 40° C., a viscosity of 24.2 cSt at 100° C., and a viscosity index of 117.

EXAMPLE 8

Complex alcohol esters when heat soaked in closed systems at 180° C., 200° C. and 225° C., respectively,

TABLE 3

| Ester | Pour Point (°C.) | Viscosity at −25° C. (cps) | Viscosity at 40° C. (cSt) | Viscosity at 100° C. (cSt) | Viscosity Index | HPDSC OIT* (min.) | Biodegradability (%) |
|---|---|---|---|---|---|---|---|
| TMP/AA/IDA | — | — | 165.7 | 21.31 | 152 | — | 67.23 |
| TMP/AA/n-C7 | −33 | 43500 | 155.6 | 18.22 | 131 | — | 80.88 |
| TPE/AA/IHA | — | — | 160.8 | 24.35 | 184 | 58.83 | 84.83 |
| TMP/iso-$C_{18}$ | −20 | 358000 | 78.34 | 11.94 | 147 | 4.29 | 63.32 |
| TMP/AA/n-C7** | −14 | solid | 27.07 | 5.77 | 163 | — | 78.84 |

*OIT denotes oxidation induction time (minutes until decomposition)
**Complex alcohol ester made without stripping the adipate
HPDSC denotes high pressure differential calorimetry
TMP is trimethylolpropane
AA is adipic acid
IDA is isodecyl alcohol
IHA is isohexyl alcohol
TPE is technical grade pentaerythritol
iso-$C_{18}$ is isostearate exhibited slight increases (approximately 1.5% to 10%) in their viscosities at 40° C. and 100° C. This viscosity data was obtained for a complex alcohol ester that had a hydroxyl number of 17.5. When a very similar complex alcohol ester with a much lower hydroxyl number of 3.7 is identically heated, it exhibited no significant increase in viscosity.

The latter, low hydroxyl complex alcohol ester was produced by using a different adipic acid to trimethylolpropane feed ratio than the high hydroxyl ester. Six esterifications at different excesses of isodecyl alcohol and adipic acid to trimethylolpropane molar ratios were carried out using a one step process in which tetraisopropyl titanate catalyst was added (at a 0.0005 catalyst to adipic acid ratio) at between 89 and 91% conversion. They were finished by simply hydrolyzing with 2 weight percent water at 90° C. for 2 hours, filtering, and stripping. It was found that as the adipic acid to trimethylolpropane molar ratio increased and the percent excess isodecyl alcohol decreased, the resulting hydroxyl number of the product decreased. Thus, when an adipic acid to trimethylolpropane ratio of 3.0 and 10% excess isodecyl alcohol were used, the complex alcohol ester produced had a 3.7 hydroxyl number.

EXAMPLE 9

The complex alcohol esters of the present invention were formed by the unique process according to the present invention wherein the catalyst is only added after approximately 90% conversion had been achieved. These esters were compared to esters formed when the catalyst was added at the outset of the esterification reaction.

Accordingly, trimethylolpropane, adipic acid and either isononyl or isodecyl alcohol were reacted in a molar ratio of 1:3:3.75 in a single stage or two reaction process until 99.5% conversion was reached. The metal catalysts were removed by treatment with aqueous sodium carbonate at less than 100° C., followed by flashing off of the water present, and filtration. The metals analysis of the resulting products are set forth below in Table 5.

TABLE 5

| Catalyst | Number of Reaction Steps | Time of Catalyst Addition | Catalyst Metal in Product (ppm) |
|---|---|---|---|
| Stannous Oxalate | 2 | 0%* | 473 |
| Stannous Oxalate | 2 | 88–90%** | 6 |
| Stannous Oxalate | 1 | 90%** | less than 1.9 |
| Tetraisopropyl Titanate | 2 | 0%* | 115 |
| Tetraisopropyl Titanate | 2 | 93%** | 45 |

*Catalyst was added at the outset of the esterification reaction before any conversion of the reaction products to the desired complex alcohol ester.
**Catalyst was added after the designated amount of conversion to the desired complex alcohol ester.

EXAMPLE 10

Trimethylol propane, adipic acid and isodecyl alcohol were reacted in a two stage reaction with a tetraisopropyl titanate catalyst added after 93% of the acid functionalities were esterified. The reaction was continued until 99.7% conversion was reached. The metal catalyst was then removed by treatment with 2% water for two hours at either 90° C. and atmospheric pressure or 145° C. and 0.5 MPa (60 psig), followed by flashing off of the water, and filtration. The titanium analysis of the two resulting products were 52 ppm for the former and 1.7 ppm for the latter.

FIG. 1 attached hereto depicts the effect of hydrolysis temperature for four samples wherein a tetraisopropyl titanate catalyst (TITA) was added to an esterification reaction mixture of trimethylol propane (TMP), adipic acid (AA) and isodecyl alcohol (IDA) at 70.7%, 77.1%, 80.9% and 85.3% of adipic acid conversion, respectively. From FIG. 1 the effect of hydrolysis temperature on the resulting titanium content and TAN of the ester product can be clearly understood.

Still other lubricants can be formed according to the present invention by blending this unique complex alcohol ester with at least one additional basestock selected from the group consisting of: mineral oils, highly refined mineral oils, poly alpha olefins, polyalkylene glycols, phosphate esters, silicone oils, diesters, polyol esters and other complex alcohol esters. The complex alcohol ester composition is blended with the additional basestocks in an amount between about 1 to 50 wt. %, based on the total blended basestock, preferably 1 to 25 wt. %, and most preferably 1 to 15 wt. %.

EXAMPLE 11

In all eighteen (18) basestocks were tested by the present inventors. The basestocks included herein are as follows:

| | |
|---|---|
| Adipates: | DIDA, DTDA |
| Polyalphaolefins: | PAO 4, PAO 6, PAO 40, PAO 100 |
| Polyisobutylenes: | PSP 5, Parapol 450, Parapol 700, Parapol 950 |
| Polyol esters: | TMP ester of n-$C_7$, n-$C_8$ and n-$C_9$ acids, TMP ester of 3,5,5-trimethylhexanoic acid, TechPE ester of iso-$C_8$, n-$C_8$ and n-$C_{10}$ acids, TechPE ester of iso-$C_8$ and 3,5,5-trimethylhexanoic acids. |
| Complex Alcohol Esters: | TMP/AA/IDA in a ratio of 1:3:3, TMP/AA/TMH in a ratio of 1:3:3. |

DIDA denotes diisodecyladipate.
DTDA denotes diisotridecyladipate.
TMP denotes trimethylolpropane
TechPE denotes technical grade pentaerythritol.
AA denotes adipic acid.
IDA denotes isodecyl alcohol.
TMH denotes 3,5,5-trimethyl-1-hexanol.
PAO denotes polyalphaolefin.

The tests that were used, and a brief description of each test, are as follows:

HPDSC—High Pressure Differential Scanning Calorimetry. A comparative measure of the thermal/oxidative stability of a sample. The HPDSC is run at 220° C. under a pressure of 500 psi of air, the sample being tested containing 0.5 wt. % Vanlube-81, an antioxidant. The time to onset of decomposition is measured. Higher stability is indicated by longer onset of decomposition times.

ASTM D-2272—Oxidation Stability of Steam Turbine Oils by Rotating Bomb (RBOT). An oxidative stability test in which the sample, a small amount of water, and a copper catalyst coil are charged to a bomb, pressured to 90 psi with oxygen at room temperature, then heated to 150° C. The time it takes for the sample to absorb a set amount of oxygen after reaching temperature is measured. As with the HPDSC, longer times indicate higher stability.

ASTM D-2893—Oxidation Characteristics of Extreme Pressure Lubrication Oils. The oil is subjected to a temperature of 95° C. in a flow of dry air for 312 hours. Changes in viscosity of the oil are measured, and the formation of precipitates and changes in color are also noted. According to this test, the smallest changes in viscosity indicate the most stable materials.

ASTM D-2783—Measurement of Extreme-Pressure Properties of Lubricating Fluids (Four-Ball Method). This test measures the load carrying characteristics of an oil. As a measure of this, the load wear index is calculated, which is an index of the ability of a lubricant to minimize wear. The higher the load wear index, the better the wear characteristics of the oil (again, a higher seizure load equates to better load carrying characteristics).

ASTM D-4172—Wear Preventive Characteristics of a Lubricating Fluid (Four-Ball Method). This is a procedure for making a "preliminary evaluation of the anti-wear properties of fluid lubricants in sliding contact." Under standard conditions (75° C., 1200 rpm, 40 kg load, 1 hour), a single steel ball is rotated against three other stationary steel balls, these last three balls being covered with the test lubricant. The average size of the scar diameters worn on the three stationary balls is a measure of the wear characteristics of the oil. The coefficient of friction, that is, the ratio of the force required to move the one rotating ball over the other three to the total force pressing the balls together, can also be determined by measuring the torque required to rotate the top ball.

ASTM D-5621—Sonic Shear Stability of Hydraulic Fluid. Evaluates the shear stability of oil by measuring changes in viscosity that result from irradiating a sample in a sonic oscillator.

The results are contained in Tables 6–9. Table 6 covers the results from thermal/oxidative stability tests. Table 7 contains the data from the wear test D-2783, while Table 8 covers the wear and friction data from D4172. Finally, the sonic shear test results are contained in Table 9.

TABLE 6

(Oxidative Stability)

| Basestock | HPDSC (Min) | RBOT (Min) | ASTM D-2893 Oxidative Stability Viscosity Change |
|---|---|---|---|
| DIDA | 6.04 | 16 | +46.61 |
| DTDA | 3.88 | 84 | +0.93 |
| PAO 4 | 3.05 | 24 | +17.39 |
| PAO 6 | 3.06 | 24 | +10.58 |
| PAO 40 | 3.05 | 24 | +25.94 |
| PAO 100 | 2.61 | 25 | +16.90 |
| PSP 5 | — | 9 | +1290.28 |
| Parapol 450 | 1.90 | 13 | +107.53 |
| Parapol 700 | 2.37 | 15 | +53.12 |
| Parapol 950 | 2.68 | 18 | +18.82 |
| TMP/n-$C_7$,$C_8$,$C_9$ acids | 17.7 | 121 | +0.25 |
| TMP/iso-$C_9$ acid | 118.6 | 193 | +1.28 |
| TechPE/iso-$C_8$, n-$C_8$,n-$C_{10}$ | 12.7 | 83 | +2.97 |
| TechPE/iso-$C_8$,$C_9$ acids | 58.7 | 120 | +1.22 |
| TMP/AA/IDA | 14.8 | 32 | +37.06 |
| TMP/AA/TMH | 66.7 | 343 | +1.26 |
| Ketjenlube 1300 | 20.1 | 69 | +41.70 |
| Ketjenlube 2300 | 11.7 | 59 | +32.81 |

All eighteen oils were tested for thermal/oxidative stability using three different tests, i.e., high pressure differential scanning calorimetry (HPDSC), rotating bomb oxidation test (RBOT, AST D-2272), and oxidation characteristics of extreme pressure lubricants (ASTM D-2893).

The primary purpose of these tests was to evaluate the complex alcohol esters of the present invention versus other conventional basestocks now used in synthetic gear oils. In that respect, the general conclusion is that the complex alcohol ester basestocks of the present invention are at least equivalent, in terms of stability, to those basestocks now being used.

The data obtained from the various lubricity/wear tests are set forth below in Tables 9 and 10. The output from the ASTM D-2783 test is the load wear index, a calculated number that is a relative measure of the load carrying characteristics of the oil. The higher the load wear index, the higher the load the oil is able to carry without showing significant wear.

The present inventors verified that the load wear index is a function of viscosity. Thus, a more viscous liquid is typically able to support a heavier load, and the results set forth below in Tables 7 and 8 confirm this general observation. It is also obvious that viscosity is not the sole determinant of load carrying characteristics. Looking at the data, it is obvious that, as a class of compounds, the complex alcohol esters show significantly higher load wear indices than would be predicted by viscosity alone.

Load Wear Index for Complex Esters

| | Viscosity @ 100° C., cSt | | Load Wear Index | |
|---|---|---|---|---|
| Ester | Actual | Predicted* | Actual | Predicted** |
| TechPE/AA/IDA | 14.8 | 115 | 24.47 | 17.3 |
| TMP/AA/TMH | 11.0 | 100 | 23.39 | 17.1 |

*Based on Load Wear Index
**Based on viscosity

As can be seen from the table above, the complex alcohol esters of the present invention behave as if they are more viscous than they actually are. Thus, their predicted load wear index, based on their viscosity, is much less than the load wear index actually measured. Likewise, the viscosity predicted based on the measured load wear index is much higher than the viscosity actually measured for these materials, as much as 4 to 10 times higher than the measured viscosity.

The reason for the high load wear index of the complex alcohol esters of the present invention has to do with the oligomeric nature of these materials. All are a mix of products, ranging from very light materials (the adipates in the case of complex alcohol esters) to very heavy components. This mix of light and heavy components results in both the viscosities and load wear indices found in this Example. The presence of light components, which in the case of the complex alcohol esters can be quite large, depresses the viscosity to give the relatively low values measured. At the same time, the presence of the very heavy, very high viscosity components imparts good wear characteristics to these complex alcohol esters, resulting in the very good wear characteristics seen in this test.

TABLE 7

(Results: ASTM D-2783 Load Wear Index)

| Basestock | Viscosity cSt @ 100° C. | Load Wear Index |
|---|---|---|
| DIDA | 3.6 | 15.66 |
| DTDA | 5.4 | 17.54 |
| PAO 4 | 4.0 | 16.72 |
| PAO 6 | 6.0 | 16.69 |
| PAO 40 | 40 | 20.91 |
| PAO 100 | 100 | 25.53 |
| PSP 5 | less than 1.0 | 10.75 |
| TMP/n-$C_7$,$C_8$,$C_9$ acids | 4.0 | 17.16 |
| TMP/iso-$C_9$ acid | 7.1 | 15.76 |
| TechPE/iso-$C_8$, n-$C_8$,n-$C_{10}$ | 6.7 | 17.88 |
| TechPE/iso-$C_8$,$C_9$ acids | 10.7 | 19.60 |

TABLE 7-continued (Results: ASTM D-2783 Load Wear Index)

| Basestock | Viscosity cSt @ 100° C. | Load Wear Index |
|---|---|---|
| TMP/AA/IDA | 14.8 | 24.47 |
| TMP/AA/TMH | 11.0 | 23.39 |
| Ketjenlube 1300 | 260 | 40.00 |
| Ketjenlube 2300 | 300 | 40.29 |

Similar results are obtained via the ASTM D-4172 test set forth in Table 8 below, i.e., decreasing wear and coefficient of friction with increasing viscosity. The results based on the coefficient of friction are very surprising. The complex alcohol esters of the present invention demonstrated very good lubricity, much better than their wear characteristics. It is believed that theses complex alcohol esters create a very "greasy" surface, but the thickness of the layer is too thin to give a proportionate decrease in wear. The very heavy components most likely impart very good wear and lubricity characteristics, but, at least in the case of wear, are diluted to some extent by the very light components.

TABLE 8

(Results: ASTM D-4172 Four-Ball Wear)

| Basestock | Viscosity cSt @ 100° C. | Wear Scar (mm) | Coefficient of Friction (average) |
|---|---|---|---|
| DIDA | 3.6 | 0.91 | 0.067 |
| DTDA | 5.4 | 0.74 | 0.111 |
| PAO 4 | 4.0 | 0.88 | 0.089 |
| PAO 6 | 6.0 | 0.67 | 0.092 |
| PAO 40 | 40 | 0.80 | 0.084 |
| PAO 100 | 100 | 0.70 | 0.100 |
| PSP 5 | — | 0.95 | 0.137 |
| TMP/n-$C_7$,$C_8$,$C_9$ acids | 4.0 | 0.66 | 0.096 |
| TMP/iso-$C_9$ acid | 7.1 | 0.91 | 0.090 |
| TechPE/iso-$C_8$, n-$C_8$,n-$C_{10}$ | 6.7 | 0.68 | 0.087 |
| TechPE/iso-$C_8$,$C_9$ acids | 10.7 | 0.94 | 0.122 |
| TMP/AA/IDA | 14.8 | 0.60 | 0.051 |
| TMP/AA/TMH | 11.0 | 0.59 | 0.056 |
| Ketjenlube 1300 | 260 | 0.32 | 0.051 |
| Ketjenlube 2300 | 300 | 0.50 | 0.061 |

Shear stability results are given in Table 9 below. The complex alcohol esters show very little viscosity loss under shear. For comparison purposes, the shear stability of two Ketjenlube samples was also determined. Similar results were obtained. Thus, it does not appear that shear stability of the complex alcohol esters of the present invention is a problem.

TABLE 9

(Results: ASTM D-5621 Sonic Shear)

| Basestock | Initial Viscosity cSt @ 40° C. | Sheared Viscosity cSt @ 40° C. | % Loss |
|---|---|---|---|
| TMP/AA/IDA | 103.45 | 102.77 | 0.66 |
| TMP/AA/TMH | 71.08 | 70.53 | 0.7 |
| Ketjenlube 1300 | 4178.34 | 4076.03 | 2.45 |
| Ketjenlube 2300 | 3807.73 | 3781.41 | 0.69 |

What is claimed is:

1. A complex alcohol ester which comprises the reaction product of an add mixture of the following:

a polyhydroxyl compound represented by the general formula:

$R(OH)_n$ wherein R is any aliphatic or cyclo-aliphatic hydrocarbyl group and n is at least 2, provided that said hydrocarbyl group contains from about 2 to 20 carbon atoms;

a polybasic acid or an anhydride of a polybasic acid, provided that the ratio of equivalents of said polybasic acid to equivalents of alcohol from said polyhydroxyl compound is in the range between about 1.6:1 to 2:1; and a monohydric alcohol, provided that the ratio of equivalents of said monohydric alcohol to equivalents of said polybasic acid is in the range between about 0.84:1 to 1.2:1;

wherein said complex alcohol ester exhibits a pour point of less than or equal to −20° C., a viscosity in the range between about 100–700 cSt at 40° C. and having a polybasic acid ester concentration of less than or equal to 70 wt. %, based on said complex alcohol ester.

2. The complex alcohol ester according to claim 1 wherein said complex alcohol ester has a pour point of less than or equal to −40° C.

3. The complex alcohol ester according to claim 1 wherein said polyhydroxyl compound is at least one compound selected from the group consisting of: technical grade pentaerythritol and mono-pentaerythritol, and the ratio of equivalents of said polybasic acid to equivalents of alcohol from said polyhydroxyl compound is in the range between about 1.75:1 to 2:1.

4. The complex alcohol ester according to claim 1 wherein said polyhydroxyl compound is at least one compound selected from the group consisting of: trimethylolpropane, trimethylolethane and trimethylolbutane, and the ratio of equivalents of said polybasic acid to equivalents of alcohol from said polyhydroxyl compound is in the range between about 1.6:1 to 2:1.

5. The complex alcohol ester according to claim 1 wherein said polyhydroxyl compound is di-pentaerythritol and the ratio of equivalents of said polybasic acid to equivalents of alcohol from said polyhydroxyl compound is in the range between about 1.83:1 to 2:1.

6. The complex alcohol ester according to claim 1 wherein said viscosity is in the range between about 100–200 at 40° C.

7. The complex alcohol ester according to claim 1 wherein said complex alcohol ester exhibits lubricity, as measured by the coefficient of friction, less than or equal to 0.1.

8. The complex alcohol ester according to claim 1 wherein said complex alcohol ester is at least about 60% biodegradable as measured by the Sturm test.

9. The complex alcohol ester according to claim 1 wherein said monohydric alcohol may be at least one alcohol selected from the group consisting of: branched and linear $C_5$ to $C_{13}$ alcohol.

10. The complex alcohol ester according to claim 9 wherein said linear monohydric alcohol is present in an amount between about 0 to 30 mole %.

11. The complex alcohol ester according to claim 10 wherein said linear monohydric alcohol is present in an amount between about 5 to 20 mole %.

12. The complex alcohol ester according to claim 9 wherein said monohydric alcohol is at least one alcohol selected from the group consisting of: $C_8$ to $C_{10}$ iso-oxo alcohols.

13. The complex alcohol ester according to claim 12 wherein said polybasic acid is adipic acid and said monohydric alcohol is either isodecyl alcohol or 2-ethylhexanol.

14. The complex alcohol ester according to claim 1 wherein said complex alcohol ester exhibits at least one of the properties selected from the group consisting of:

(a) a total acid number of less than or equal to about 1.0 mgKOH/gram, (b) a hydroxyl number in the range between about 0 to 50 mgKOH/gram, (c) a metal catalyst content of less than about 25 ppm, (d) a molecular weight in the range between about 275 to 250,000 Daltons, (e) a seal swell equal to about diisotridecyladipate, (f) a viscosity at −25° C. of less than or equal to about 100,000 cps, (g) a flash point of greater than about 200° C., (h) aquatic toxicity of greater than about 1,000 ppm, (i) a specific gravity of less than about 1.0, (j) a viscosity index equal to or greater than about 150, and (k) an oxidative and thermal stability as measured by HPDSC at 220° C. of greater than about 10 minutes.

15. A lubricant which comprises said complex alcohol ester of claim 1 and a lubricant additive package.

16. The lubricant according to claim 15 wherein said additive package comprises at least one additive selected from the group consisting of: viscosity index improvers, corrosion inhibitors, oxidation inhibitors, dispersants, lube oil flow improvers, detergents and rust inhibitors, pour point depressants, anti-foaming agents, anti-wear agents, seal swellants, friction modifiers, extreme pressure agents, color stabilizers, demulsifiers, wetting agents, water loss improving agents, bactericides, drill bit lubricants, thickeners or gellants, anti-emulsifying agents, metal deactivators, coupling agents, surfactants, and additive solubilizers.

17. The lubricant according to claim 15 wherein said lubricant is selected from the group consisting of: crankcase engine oils, two-cycle engine oils, catapult oils, hydraulic fluids, drilling fluids, aircraft and other turbine oils, greases, compressor oils, functional fluids, gear oils, and other industrial and engine lubrication applications.

18. A process for producing complex alcohol ester with low metal catalyst content and a low total acid number which comprises the steps of:

(a) reacting a polyhydroxyl compound, a polybasic acid or an anhydride of a polybasic acid, and a monohydric alcohol at temperatures and pressures capable of causing the esterification of the reaction mixture;

(b) adding a metal catalyst to said reaction mixture to form a crude complex alcohol ester product; and (c) hydrolyzing said crude complex alcohol ester product in the presence of between about 0.5 to 4 wt. % water, based on said crude complex alcohol ester product, at a temperature of between about 100° to 200° C. and a pressure greater than 1 atmosphere, thereby producing a complex alcohol ester.

19. The process according to claim 18 wherein the reactants are added in such amount that (1) the ratio of equivalents of said polybasic acid to equivalents of alcohol from said polyhydroxyl compound is in the range between about 1.6:1 to 2:1; and (2) a monohydric alcohol, provided that the ratio of equivalents of said monohydric alcohol to equivalents of said polybasic acid is in the range between about 0.84:1 to 1.2:1; wherein said complex alcohol ester exhibits a pour point of less than or equal to −20° C., a viscosity in the range between about 100–700 cSt at 40° C. and having a polybasic acid ester concentration of less than or equal to 70 wt. %, based on said complex alcohol ester.

20. The process according to claim 19 wherein said complex alcohol ester exhibits at least one of the properties selected from the group consisting of:

(a) a total acid number of less than or equal to about 1.0 mgKOH/gram, (b) a hydroxyl number in the range between about 0 to 50 mgKOH/gram, (c) a metal catalyst content of less than about 25 ppm, (d) a molecular weight in the range between about 275 to 250,000 Daltons, (e) a seal swell equal to about diisotridecyladipate, (f) a viscosity at −25° C. of less than or equal to about 100,000 cps, (g) a flash point of greater than about 200° C., (h) aquatic toxicity of greater than about 1,000 ppm, (i) a specific gravity of less than about 1.0, (j) a viscosity index equal to or greater than about 150, and (k) an oxidative and thermal stability as measured by HPDSC at 220° C. of greater than about 10 minutes.

21. The process according to claim 18 wherein said complex alcohol ester is at least about 60% biodegradable as measured by the Sturm test.

22. The process according to claim 18 wherein said hydrolyzing step has a temperature in the range between about 110° to 175° C.

23. The process according to claim 22 wherein said hydrolyzing step has a temperature in the range between about 125° to 160° C.

24. The process according to claim 18 wherein said hydrolyzing step wherein said water is added in an amount between about 2 to 3 wt. %.

25. The process according to claim 18 further comprising the steps of:

(d) adding at least one adsorbent to said reaction mixture following esterification;

(e) removing water used in hydrolysis step (c) by heat and vacuum in a flash step;

(f) filtering solids from the esterified reaction mixture;

(g) removing excess alcohol by steam stripping or any other distillation method; and (h) removing residual solids from the stripped ester in a final filtration.

* * * * *

US005750750C1

(12) REEXAMINATION CERTIFICATE (4301st)

United States Patent

Duncan et al.

(10) Number: US 5,750,750 C1

(45) Certificate Issued: Mar. 27, 2001

(54) HIGH VISCOSITY COMPLEX ALCOHOL ESTERS

(75) Inventors: Carolyn Boggus Duncan; Paul R. Geissler; David Wayne Turner, all of Baton Rouge, LA (US); William Joseph Munley, Jr., Houston, TX (US); Martin A. Krevalis, Baton Rouge, LA (US)

(73) Assignee: Exxon Chemical Patents Inc., Houston, TX (US)

Reexamination Request:
No. 90/005,114, Sep. 23, 1998

Reexamination Certificate for:

| | |
|---|---|
| Patent No.: | **5,750,750** |
| Issued: | **May 12, 1998** |
| Appl. No.: | **08/799,011** |
| Filed: | **Feb. 7, 1997** |

(51) Int. Cl.[7] ..... C07C 59/47

(52) U.S. Cl. ..... 554/117; 554/121; 554/122; 508/485; 508/492; 508/495; 560/126; 560/182; 560/193; 560/194; 560/198; 560/199

(58) Field of Search ..... 554/117, 121, 554/122; 508/485, 492, 495; 560/126, 182, 193, 194, 198, 199

(56) References Cited

U.S. PATENT DOCUMENTS

| | | |
|---|---|---|
| 4,155,861 | 5/1979 | Schmitt et al. . |
| 5,372,736 | 12/1994 | Trivett . |
| 5,560,850 | 10/1996 | Hoppe et al. . |

FOREIGN PATENT DOCUMENTS

| | | |
|---|---|---|
| 0 218 207 | 4/1987 | (EP) . |
| 0 335 013 | 10/1989 | (EP) . |
| 0 440 069 | 8/1991 | (EP) . |
| 0 706 992 | 4/1996 | (EP) . |
| 2 187 894 | 4/1987 | (FR) . |
| 1 460 665 | 1/1977 | (GB) . |

OTHER PUBLICATIONS

PCT International Search Report dated Jan. 13, 1998.

*Primary Examiner*—Samuel Barts

(57) ABSTRACT

A complex alcohol ester which comprises the reaction product of an add mixture of the following: a polyhydroxyl compound represented by the general formula:

$$R(OH)_n$$

wherein R is any aliphatic or cyclo-aliphatic hydrocarbyl group and n is at least 2, provided that the hydrocarbyl group contains from about 2 to 20 carbon atoms; a polybasic acid or an anhydride of a polybasic acid, provided that the ratio of equivalents of the polybasic acid to equivalents of alcohol from the polyhydroxyl compound is in the range between about 1.6:1 to 2:1; and a monohydric alcohol, provided that the ratio of equivalents of the monohydric alcohol to equivalents of the polybasic acid is in the range between about 0.84:1 to 1.2:1; wherein the complex alcohol ester exhibits a pour point of less than or equal to −20° C., a viscosity in the range between about 100–700 cSt at 40° C. and having a polybasic acid ester concentration of less than or equal to 70 wt. %, based on the complex alcohol ester.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 19 is cancelled.

Claims 1 and 18 are determined to be patentable as amended.

Claims 2–17 and 20–25, dependent on an amended claim, are determined to be patentable.

1. A complex alcohol ester which [comprises the] *is a* reaction product of an add mixture [of the following] *comprising*:

a polyhydroxyl compound [represented by the general formula:

$$R(OH)_n$$

wherein R is any aliphatic or cyclo-aliphatic hydrocarbyl group and n is at least 2, provided that said hydrocarbyl group contains from about 2 to 20 carbon atoms] *selected from the group consisting of neopentyl glycol, technical grade pentaerythritol, mono-pentaerythritol, di-pentaerythritol, trimethylolpropane, trimethylolethane and trimethylolbutane*;

a polybasic acid or an anhydride of a polybasic acid, provided that the ratio of equivalents of said polybasic acid to equivalents of alcohol from said polyhydroxyl compound is in the range between about 1.6:1 to 2:1; and a monohydric alcohol, provided that the ratio of equivalents of said monohydric alcohol to equivalents of said polybasic acid is in the range between about 0.84:1 to 1.2:1;

wherein said complex alcohol ester exhibits a pour point of less than or equal to −20° C., a viscosity in the range between about 100–700 cSt at 40° C. and having a polybasic acid ester concentration of less than or equal to 70 wt. %, based on said complex alcohol ester.

18. A process for producing complex alcohol ester with low metal catalyst content and a low total acid number which comprises the steps of:

(a) reacting a polyhydroxyl compound *selected from the group consisting of neopentyl glycol, technical grade pentaerythritol, mono-pentaerythritol, di-pentaerythritol, trimethylolpropane, trimethylolethane and trimethylolbutane*, a polybasic acid or an anhydride of a polybasic acid, *provided that the ratio of equivalents of said polybasic acid to equivalents of alcohol from said polyhydroxyl compound is in the range between about 1.6:1 to 2:1,* and a monohydric alcohol, *provided that the ratio of equivalents of said monohydric alcohol to equivalents of said polybasic acid is in the range between about 0.84:1 to 1.2:1,* at temperatures and pressures capable of causing the esterification of the reaction mixture;

(b) adding a metal catalyst to said reaction mixture to form a crude complex alcohol ester product; and (c) hydrolyzing said crude complex alcohol ester product in the presence of between about 0.5 to 4 wt. % water, based on said crude complex alcohol ester product, at a temperature of between about 100° to 200° C. and a pressure greater than 1 atmosphere, thereby producing a complex alcohol ester *which exhibits a pour point of less than or equal to −20° C., a viscosity in the range between about 100–700 cSt at 40° C. and having a polybasic acid ester concentration of less than or equal to 70 wt. %, based on said complex alcohol ester.*

* * * * *